US011508289B2

(12) United States Patent
Xuan et al.

(10) Patent No.: US 11,508,289 B2
(45) Date of Patent: Nov. 22, 2022

(54) PIXEL DRIVING CIRCUIT, METHOD OF DRIVING THE SAME AND DISPLAY DEVICE

(71) Applicant: BOE TECHNOLOGY GROUP CO., LTD., Beijing (CN)

(72) Inventors: Minghua Xuan, Beijing (CN); Xiaochuan Chen, Beijing (CN); Dongni Liu, Beijing (CN)

(73) Assignee: BEIJING BOE TECHNOLOGY DEVELOPMENT CO., LTD., Beijing (CN)

( * ) Notice: Subject to any disclaimer, the term of this patent is extended or adjusted under 35 U.S.C. 154(b) by 0 days.

(21) Appl. No.: 16/977,220

(22) PCT Filed: Nov. 29, 2019

(86) PCT No.: PCT/CN2019/121957
§ 371 (c)(1),
(2) Date: Sep. 1, 2020

(87) PCT Pub. No.: WO2021/102906
PCT Pub. Date: Jun. 3, 2021

(65) Prior Publication Data
US 2021/0225264 A1 Jul. 22, 2021

(51) Int. Cl.
*G09G 3/32* (2016.01)
*G09G 3/3233* (2016.01)

(52) U.S. Cl.
CPC ..... *G09G 3/32* (2013.01); *G09G 3/3233* (2013.01); *G09G 2300/0426* (2013.01);
(Continued)

(58) Field of Classification Search
CPC ..... G09G 3/30; G09G 3/32; G09G 3/3208; G09G 3/3225; G09G 3/325; G09G 3/3233;
(Continued)

(56) References Cited

U.S. PATENT DOCUMENTS 9,396,681 B2 * 7/2016 In ..... G09G 3/3266
2011/0001740 A1 1/2011 Jo
(Continued)

FOREIGN PATENT DOCUMENTS

CN 107103879 A 8/2017
CN 108665852 A 10/2018
CN 109935207 A 6/2019

*Primary Examiner* — Jason M Mandeville
(74) *Attorney, Agent, or Firm* — Muncy, Geissler, Olds & Lowe, P.C.

(57) ABSTRACT

The present disclosure provides a pixel driving circuit, a method of driving the same and a display device. The pixel driving circuit includes a light-emission time control sub-circuitry, a first energy storage sub-circuitry, a first resetting sub-circuitry, a first light-emission control sub-circuitry, a time control data write-in sub-circuitry and a data control sub-circuitry. The time control data write-in sub-circuitry controls a time control data line to be electrically connected to a second end of the first energy storage sub-circuitry under the control of a first gate driving signal. The light-emission time control sub-circuitry controls a first end of the light-emission time control sub-circuitry to be electrically connected to a second end of the light-emission time control sub-circuitry.

18 Claims, 15 Drawing Sheets

(52) U.S. Cl.
CPC ..... *G09G 2300/0819* (2013.01); *G09G 2300/0842* (2013.01); *G09G 2300/0852* (2013.01); *G09G 2300/0861* (2013.01); *G09G 2310/027* (2013.01); *G09G 2310/0251* (2013.01); *G09G 2310/061* (2013.01); *G09G 2310/066* (2013.01); *G09G 2320/0242* (2013.01)

(58) Field of Classification Search
CPC ... G09G 2300/0426; G09G 2300/0439; G09G 2300/0819; G09G 2300/0842; G09G 2300/0852; G09G 2300/0861; G09G 2310/0251; G09G 2310/027; G09G 2310/061; G09G 2310/066; G09G 2320/0242
USPC ..... 345/76
See application file for complete search history.

(56) References Cited

U.S. PATENT DOCUMENTS

| | | | | |
|---|---|---|---|---|
| 2020/0027402 | A1 | 1/2020 | Xiao et al. | |
| 2020/0152119 | A1 | 5/2020 | Xuan | |
| 2020/0402457 | A1* | 12/2020 | Ueno ..... | G09G 3/3233 |

* cited by examiner

PIXEL DRIVING CIRCUIT, METHOD OF DRIVING THE SAME AND DISPLAY DEVICE

CROSS-REFERENCE TO RELATED APPLICATION

The present application is the U.S. national phase of PCT Application No. PCT/CN2019/121957 filed on Nov. 29, 2019, the disclosure of which is incorporated herein by reference in its entirety.

TECHNICAL FIELD

The present disclosure relates to the field of display technology, in particular to a pixel driving circuit, a method of driving the same and a display device.

BACKGROUND

In the related art, micro Light-Emitting Diode (LED) has been considered as a next-generation display technology due to such characteristics as low driving voltage, ultra-high brightness, long service life and high temperature resistance. When the micro LED is driven by an existing pixel driving circuit, there exist such problems as chromaticity coordinate offset at different currents and unstable brightness at a low current density.

SUMMARY

In one aspect, a pixel driving circuit is provided in some embodiments of the present disclosure, including a light-emission time control sub-circuitry, a first energy storage sub-circuitry, a first resetting sub-circuitry, a first light-emission control sub-circuitry, a time control data write-in sub-circuitry and a data control sub-circuitry. The first resetting sub-circuitry is electrically connected to a resetting control line, a first initial voltage end, and a first end, a control end and a second end of the light-emission time control sub-circuitry, and configured to write a first initial voltage from the first initial voltage end into the first end of the light-emission time control sub-circuitry under the control of a resetting control signal from the resetting control line, and control the control end of the light-emission time control sub-circuitry to be electrically connected to the second end of the light-emission time control sub-circuitry under the control of the resetting control signal. A first end of the first energy storage sub-circuitry is electrically connected to the control end of the light-emission time control sub-circuitry, and the first energy storage sub-circuitry is configured to store a voltage. The time control data write-in sub-circuitry is electrically connected to a first gate line, a time control data line and a second end of the first energy storage sub-circuitry, and configured to control the time control data line to be electrically connected to the second end of the first energy storage sub-circuitry under the control of a first gate driving signal from the first gate line. The data control sub-circuitry is electrically connected to a light-emission control line, the time control data line and the second end of the first energy storage sub-circuitry, and configured to control the time control data line to be electrically connected to the second end of the first energy storage sub-circuitry under the control of a light-emission control signal from the light-emission control line. The first light-emission control sub-circuitry is electrically connected to the light-emission control line, the first end of the light-emission time control sub-circuitry and a first voltage end, and configured to control the first end of the light-emission time control sub-circuitry to be electrically connected to the first voltage end under the control of the light-emission control signal. The second end of the light-emission time control sub-circuitry is electrically connected to an output end, and the light-emission time control sub-circuitry is configured to control the first end of the light-emission time control sub-circuitry to be electrically connected to the second end of the light-emission time control sub-circuitry under the control of a potential at the control end of the light-emission time control sub-circuitry.

In a possible embodiment of the present disclosure, the pixel driving circuit further includes a second light-emission control sub-circuitry electrically connected to the light-emission control line, the second end of the light-emission time control sub-circuitry and the output end, and configured to control the second end of the light-emission time control sub-circuitry to be electrically connected to the output end under the control of the light-emission control signal.

In a possible embodiment of the present disclosure, the light-emission time control sub-circuitry includes a light-emission time control transistor, a control electrode of which is the control end of the light-emission time control sub-circuitry, a first electrode of which is the first end of the light-emission time control sub-circuitry, and a second electrode of which is the second end of the light-emission time control sub-circuitry.

In a possible embodiment of the present disclosure, the first resetting sub-circuitry includes a first resetting transistor and a second resetting transistor. A control electrode of the first resetting transistor is electrically connected to the resetting control line, a first electrode of the first resetting transistor is electrically connected to the control end of the light-emission time control sub-circuitry, and a second electrode of the first resetting transistor is electrically connected to the second end of the light-emission time control sub-circuitry. A control electrode of the second resetting transistor is electrically connected to the resetting control line, a first electrode of the second resetting transistor is electrically connected to the first end of the light-emission time control sub-circuitry, and a second electrode of the second resetting transistor is electrically connected to the first initial voltage end for applying the first initial voltage.

In a possible embodiment of the present disclosure, the time control data write-in sub-circuitry includes a time control data write-in transistor, a control electrode of which is electrically connected to the first gate line, a first electrode of which is electrically connected to the time control data line, and a second electrode of which is electrically connected to the second end of the first energy storage sub-circuitry.

In a possible embodiment of the present disclosure, the data control sub-circuitry includes a data control transistor, and the first energy storage sub-circuitry includes a time control capacitor. A control electrode of the data control transistor is electrically connected to the light-emission control line, a first electrode of the data control transistor is electrically connected to the time control data line, and a second electrode of the data control transistor is electrically connected to the second end of the first energy storage sub-circuitry. The first end of the first energy storage sub-circuitry is a first end of the time control capacitor, and the second end of the first energy storage sub-circuitry is a second end of the time control capacitor.

In a possible embodiment of the present disclosure, the first light-emission control sub-circuitry includes a first light-emission control transistor, a control electrode of which is electrically connected to the light-emission control line, a first electrode of which is electrically connected to the first voltage end, and a second electrode of which is electrically connected to the first end of the light-emission time control sub-circuitry.

In a possible embodiment of the present disclosure, the second light-emission control sub-circuitry includes a second light-emission control transistor, a control electrode of which is electrically connected to the light-emission control line, a first electrode of which is electrically connected to the second end of the light-emission time control sub-circuitry, and a second electrode of which is electrically connected to the output end.

In a possible embodiment of the present disclosure, the light-emission time control sub-circuitry includes a light-emission time control transistor, the first resetting sub-circuitry includes a first resetting transistor and a second resetting transistor, the time control data write-in sub-circuitry includes a time control data write-in transistor, the data control sub-circuitry includes a data control transistor, the first light-emission control sub-circuitry includes a first light-emission control transistor, and the first energy storage sub-circuitry includes a time control capacitor. A control electrode of the light-emission time control transistor is the control end of the light-emission time control sub-circuitry, a first electrode of the light-emission time control transistor is the first end of the light-emission time control sub-circuitry, and a second electrode of the light-emission time control transistor is the second end of the light-emission time control sub-circuitry. A control electrode of the first resetting transistor is electrically connected to the resetting control line, a first electrode of the first resetting transistor is electrically connected to the control end of the light-emission time control sub-circuitry, and a second electrode of the first resetting transistor is electrically connected to the second end of the light-emission time control sub-circuitry. A control electrode of the second resetting transistor is electrically connected to the resetting control line, a first electrode of the second resetting transistor is electrically connected to the first end of the light-emission time control sub-circuitry, and a second electrode of the second resetting transistor is electrically connected to the first initial voltage end for applying the first initial voltage. A control electrode of the time control data write-in transistor is electrically connected to the first gate line, a first electrode of the time control data write-in transistor is electrically connected to the time control data line, and a second electrode of the time control data write-in transistor is electrically connected to the second end of the first energy storage sub-circuitry. A control electrode of the data control transistor is electrically connected to the light-emission control line, a first electrode of the data control transistor is electrically connected to the time control data line, and a second electrode of the data control transistor is electrically connected to the second end of the first energy storage sub-circuitry. A control electrode of the first light-emission control transistor is electrically connected to the light-emission control line, a first electrode of the first light-emission control transistor is electrically connected to the first voltage end, and a second electrode of the first light-emission control transistor is electrically connected to the first end of the light-emission time control sub-circuitry. The first end of the first energy storage sub-circuitry is a first end of the time control capacitor, and the second end of the first energy storage sub-circuitry is a second end of the time control capacitor.

In a possible embodiment of the present disclosure, the pixel driving circuit further includes a second light-emission control sub-circuitry, and the second light-emission control sub-circuitry includes a second light-emission control transistor, a control electrode of which is electrically connected to the light-emission control line, a first electrode of which is electrically connected to the second end of the light-emission control sub-circuitry, and a second electrode of which is electrically connected to the output end.

In a possible embodiment of the present disclosure, the pixel driving circuit further includes a current driving sub-circuitry connected between the second end of the light-emission time control sub-circuitry and the output end, electrically connected to a current control data line and the output end, and configured to generate a driving current to be outputted to the output end at a light-emission stage in accordance with a current control data voltage from the current control data line.

In a possible embodiment of the present disclosure, the current driving sub-circuitry includes a driving sub-circuitry, a current control data write-in sub-circuitry, a second resetting sub-circuitry, a compensation sub-circuitry and a second energy storage sub-circuitry. A first end of the driving sub-circuitry is electrically connected to the second end of the light-emission time control sub-circuitry, a second end of the driving sub-circuitry is electrically connected to the output end, and the driving sub-circuitry is configured to control the first end of the driving sub-circuitry to be electrically connected to the second end of the driving sub-circuitry under the control of a potential at a control end of the driving sub-circuitry. A first end of the second energy storage sub-circuitry is electrically connected to the control end of the driving sub-circuitry, a second end of the second energy storage sub-circuitry is electrically connected to a second voltage end, and the second energy storage sub-circuitry is configured to store a voltage. The current control data write-in sub-circuitry is electrically connected to a second gate line, the current control data line and the first end of the driving sub-circuitry, and configured to control the current control data line to be electrically connected to the first end of the driving sub-circuitry under the control of a second gate driving signal from the second gate line. The second resetting sub-circuitry is electrically connected to the resetting control line, a second initial voltage end and the control end of the driving sub-circuitry, and configured to apply a second initial voltage from the second initial voltage end to the control end of the driving sub-circuitry under the control of the resetting control signal from the resetting control line. The compensation sub-circuitry is electrically connected to the second gate line, the control end of the driving sub-circuitry and the second end of the driving sub-circuitry, and configured to control the control end of the driving sub-circuitry to be electrically connected to the second end of the driving sub-circuitry under the control of the second gate driving signal.

In a possible embodiment of the present disclosure, the pixel driving circuit further includes a second light-emission control sub-circuitry through which the first end of the driving sub-circuitry is electrically connected to the second end of the light-emission time control sub-circuitry. A control end of the second light-emission control sub-circuitry is electrically connected to the light-emission control line, a first end of the second light-emission control sub-circuitry is electrically connected to the second end of the light-emission time control sub-circuitry, and a second end of the second light-emission control sub-circuitry is electrically connected to the driving sub-circuitry. The second light-emission control sub-circuitry is configured to control the second end of the light-emission time control sub-circuitry to be electrically connected to the driving sub-circuitry under the control of the light-emission control signal from the light-emission control line.

In a possible embodiment of the present disclosure, the pixel driving circuit further includes a third light-emission control sub-circuitry through which the second end of the driving sub-circuitry is electrically connected to the output end. A control end of the third light-emission control sub-circuitry is electrically connected to the light-emission control line, and the third light-emission control sub-circuitry is configured to control the second end of the driving sub-circuitry to be electrically connected to the output end under the control of the light-emission control signal from the light-emission control line.

In a possible embodiment of the present disclosure, the driving sub-circuitry includes a driving transistor, the second energy storage sub-circuitry includes a current control capacitor, the current control data write-in sub-circuitry includes a current control data write-in transistor, the second resetting sub-circuitry includes a third resetting transistor, and the compensation sub-circuitry includes a compensation transistor. A control electrode of the driving transistor is electrically connected to a first end of the current control capacitor, a first electrode of the driving transistor is electrically connected to the second end of the light-emission time control sub-circuitry, and a second electrode of the driving transistor is electrically connected to the output end. A control electrode of the current control data write-in transistor is electrically connected to the second gate line, a first electrode of the current control data write-in transistor is electrically connected to the current control data line, and a second electrode of the current control data write-in transistor is electrically connected to the first end of the driving sub-circuitry. A control electrode of the third resetting transistor is electrically connected to the resetting control line, a first electrode of the third resetting transistor is electrically connected to the second initial voltage end, and a second electrode of the third resetting transistor is electrically connected to the control end of the driving sub-circuitry. A control electrode of the compensation transistor is electrically connected to the second gate line, a first electrode of the compensation transistor is electrically connected to the control end of the driving sub-circuitry, and a second electrode of the compensation transistor is electrically connected to the second end of the driving sub-circuitry.

In a possible embodiment of the present disclosure, the third light-emission control sub-circuitry includes a third light-emission control transistor, a control electrode of which is electrically connected to the light-emission control line, a first electrode of which is electrically connected to the second end of the driving sub-circuitry, and a second electrode of which is electrically connected to the output end.

In a possible embodiment of the present disclosure, the pixel driving circuit is configured to drive a light-emitting element, the output end is electrically connected to a first electrode of the light-emitting element, and a second electrode of the light-emitting element is electrically connected to a third voltage end.

In a possible embodiment of the present disclosure, the light-emitting element is a micro LED.

In another aspect, a method for driving the above-mentioned pixel driving circuit is provided in some embodiments of the present disclosure, including: applying an ON signal to the resetting control line and the first gate line to write the first initial voltage into the first end of the light-emission time control sub-circuitry, enable the control end of the light-emission time control sub-circuitry to be electrically connected to the second end of the light-emission time control sub-circuitry, write a predetermined time control data voltage from the time control data line into the second end of the first energy storage sub-circuitry, enable the first end of the light-emission time control sub-circuitry to be electrically connected to the second end of the light-emission time control sub-circuitry, and change a voltage applied to the first end of the first energy storage sub-circuitry until the light-emission time control sub-circuitry has been turned off; applying an ON signal to the first gate line to write a predetermined voltage from the time control data line into the second end of the first energy storage sub-circuitry, and change the voltage applied to the first end of the first energy storage sub-circuitry; and applying an ON signal to the light-emission control line to enable the first end of the light-emission time control sub-circuitry to be electrically connected to the first voltage end, enable the time control data line to be electrically connected to the second end of the first energy storage sub-circuitry, and change the voltage applied to the first end of the first energy storage sub-circuitry and enable the first end of the light-emission time control sub-circuitry to be electrically connected to, or electrically disconnected from, the second end of the light-emission time control sub-circuitry.

In a possible embodiment of the present disclosure, the pixel driving circuit further includes a current driving sub-circuitry. The method further includes, when applying the ON signal to the light-emission control line, generating, by the current driving sub-circuitry, a driving current to be outputted to the output end in accordance with a current control data voltage from the current control data line.

In a possible embodiment of the present disclosure, the current driving sub-circuitry includes a driving sub-circuitry, a current control data write-in sub-circuitry, a second resetting sub-circuitry, a compensation sub-circuitry and a second energy storage sub-circuitry, and the output end is electrically connected to a light-emitting element. The method further includes: when applying the ON signal to the resetting control line and the first gate line, writing a second initial voltage into a control end of the driving sub-circuitry to enable a first end of the driving sub-circuitry to be electrically disconnected from a second end of the driving sub-circuitry; when applying the ON signal to the first gate line, applying an ON signal to a second gate line to write the predetermined current control data voltage from the current control data line into the first end of the driving sub-circuitry, enable the control end of the driving sub-circuitry to be electrically connected to the second end of the driving sub-circuitry, and change a potential at the control end of the driving sub-circuitry until the driving sub-circuitry has been turned off; and when applying the ON signal to the light-emission control line, generating, by the driving sub-circuitry, a driving current for driving the light-emitting element to emit light.

In yet another aspect, a display device is provided in some embodiments of the present disclosure, including the above-mentioned pixel driving circuit.

DETAILED DESCRIPTION

The technical solutions in the embodiments of the present disclosure will be described hereinafter clearly and completely with reference to the drawings of the embodiments of the present disclosure. Obviously, the following embodiments merely relate to a part of, rather than all of, the embodiments of the present disclosure, and based on these embodiments, a person skilled in the art may, without any creative effort, obtain the other embodiments, which also fall within the scope of the present disclosure.

In the embodiments of the present disclosure, each transistor maybe a triode, a thin film transistor (TFT), a field effect transistor (FET), or any other element having a same characteristic. In order to differentiate between two electrodes of the transistor other than a control electrode, one of them may be called as a first electrode, and the other may be called as a second electrode.

In actual use, when the transistor is a triode, the control electrode may be a base, the first electrode may be a collector and the second electrode may be an emitter, or the control electrode may be a base, the first electrode may be an emitter and the second electrode may be a collector.

In actual use, when the transistor is a TFT or FET, the control electrode may be a gate electrode, the first electrode may be a drain electrode and the second electrode may be a source electrode, or the control electrode may be a gate electrode, the first electrode may be a source electrode and the second electrode may be a drain electrode.

Figure 1A:
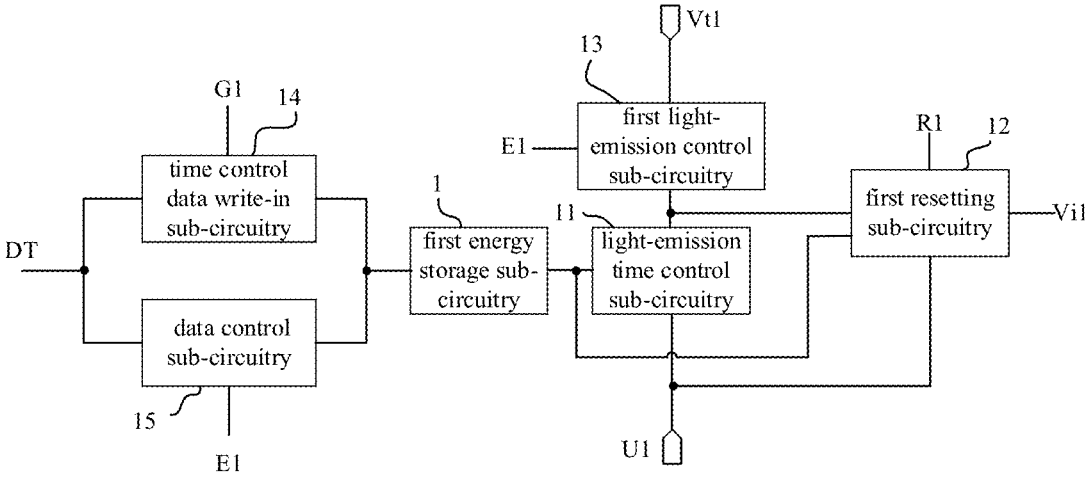
FIG. 1A is a schematic view showing a pixel diving circuit according to one embodiment of the present disclosure.

As shown in FIG. 1A, a pixel driving circuit is provided in some embodiments of the present disclosure, which includes a light-emission time control sub-circuitry 11, a first resetting sub-circuitry 12, a first light-emission control sub-circuitry 13, a time control data write-in sub-circuitry 14, a data control sub-circuitry 15 and a first energy storage sub-circuitry 1.

The first resetting sub-circuitry 12 is electrically connected to a resetting control line R1, a first initial voltage end, and a first end, a control end and a second end of the light-emission time control sub-circuitry 11, and configured to write a first initial voltage Vi1 from the first initial voltage end into the first end of the light-emission time control sub-circuitry 11 under the control of a resetting control signal from the resetting control line R1, and control the control end of the light-emission time control sub-circuitry 11 to be electrically connected to the second end of the light-emission time control sub-circuitry 11 under the control of the resetting control signal.

A first end of the first energy storage sub-circuitry 1 is electrically connected to the control end of the light-emission time control sub-circuitry 11, and the first energy storage sub-circuitry 1 is configured to store a voltage.

The time control data write-in sub-circuitry 14 is electrically connected to a first gate line G1, a time control data line DT and a second end of the first energy storage sub-circuitry 1, and configured to control the time control data line DT to be electrically connected to the second end of the first energy storage sub-circuitry 1 under the control of a first gate driving signal from the first gate line G1.

The data control sub-circuitry 15 is electrically connected to a light-emission control line E1, the time control data line DT and the second end of the first energy storage sub-circuitry 1, and configured to control the time control data line DT to be electrically connected to the second end of the first energy storage sub-circuitry 1 under the control of a light-emission control signal from the light-emission control line E1.

The first light-emission control sub-circuitry 13 is electrically connected to the light-emission control line E1, the first end of the light-emission time control sub-circuitry 11 and a first voltage end Vt1, and configured to control the first end of the light-emission time control sub-circuitry 11 to be electrically connected to the first voltage end Vt1 under the control of the light-emission control signal.

The second end of the light-emission time control sub-circuitry 11 is electrically connected to an output end U1, and the light-emission time control sub-circuitry 11 is configured to control the first end of the light-emission time control sub-circuitry 11 to be electrically connected to the second end of the light-emission time control sub-circuitry 11 under the control of a potential at the control end of the light-emission time control sub-circuitry 11.

In some embodiments of the present disclosure, the pixel driving circuit is configured to drive a light-emitting element, and the output end U1 may be electrically connected to the light-emitting element.

According to the pixel driving circuit in the embodiments of the present disclosure, a luminous brightness value may be determined through controlling a light-emission time of the light-emitting element, so it is able to prevent the occurrence of chromaticity coordinate offset at different currents and unstable brightness at a low current density for the light-emitting element, adjust the luminous brightness value through adjusting the light-emission time of the light-emitting element at a fixed large current density, and compensate for the luminous brightness value when a threshold voltage drift occurs for a transistor due to a low-temperature polycrystalline silicon technology.

In some embodiments of the present disclosure, the light-emitting element may be, but not limited to, a micro LED or an Organic Light-Emitting Diode (OLED).

In some embodiments of the present disclosure, a voltage applied by the first voltage end Vt1 may be associated with a type of a light-emission time control transistor of the light-emission time control sub-circuitry 11. When the light-emission time control transistor is a p-type transistor, a first voltage applied by the first voltage end Vt1 may be, but not limited to, a voltage of 0V or a negative voltage. When the light-emission time control transistor is an n-type transistor, the first voltage applied by the first voltage end Vt1 may be, but not limited to, a positive voltage.

In the embodiments of the present disclosure, the first energy storage sub-circuitry 1 may include, but not limited to, a time control capacitor.

Figure 1B:
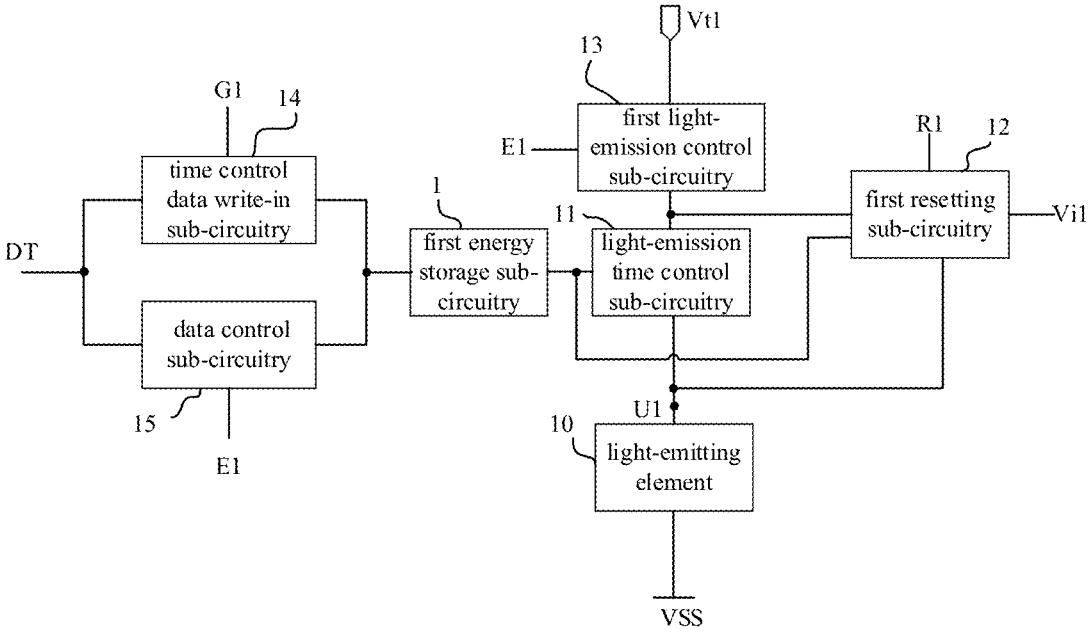
FIG. 1B is another schematic view showing the pixel driving circuit according to one embodiment of the present disclosure.

As shown in FIG. 1B, on the basis of the pixel driving circuit in FIG. 1A, a light-emitting element 10 is added. A first electrode of the light-emitting element 10 may be electrically connected to, but not limited to, the output end U1, and a second electrode of the light-emitting element 10 may receive, but not limited to, a low voltage VSS.

In some embodiments of the present disclosure, the first electrode of the light-emitting element 10 may be, but not limited to, an anode, and the second electrode of the light-emitting element 10 may be, but not limited to, a cathode.

During the operation of the pixel driving circuit in the embodiments of the present disclosure, a display period may include a resetting time period, a compensation time period and a light-emission stage.

Within the resetting time period, the first resetting sub-circuitry 12 may write the first initial voltage Vi1 into the first end of the light-emission time control sub-circuitry 11 and control the control end of the light-emission time control sub-circuitry 11 to be electrically connected to the second end of the light-emission time control sub-circuitry 11 under the control of the resetting control signal. The time control data write-in sub-circuitry 14 may write a predetermined time control data voltage VdT from the time control data line into the second end of the first energy storage sub-circuitry 1 under the control of the first gate driving signal. The light-emission time control sub-circuitry 11 may control the first end of the light-emission time control sub-circuitry 11 to be electrically connected to the second end of the light-emission time control sub-circuitry 11 under the control of the control end of the light-emission time control sub-circuitry 11. In this way, it is able to correspondingly change a voltage applied to the first end of the first energy storage sub-circuitry 1 until the light-emission time control sub-circuitry 11 has been turned off.

Within the compensation time period, the time control data write-in sub-circuitry 14 may write a predetermined voltage V0 from the time control data line DT into the second end of the first energy storage sub-circuitry 1 under the control of the first gate driving signal from the first gate line G1, so as to correspondingly change the voltage applied to the first end of the first energy storage sub-circuitry 1.

At the light-emission stage, the first light-emission control sub-circuitry 13 may control the first end of the light-emission time control sub-circuitry 11 to be electrically connected to the first voltage end Vt1 under the control of the light-emission control signal, the data control sub-circuitry 15 may control the time control data line DT to be electrically connected to the second end of the first energy storage sub-circuitry 1 under the control of the light-emission control signal from the light-emission control line E1, so as to correspondingly change the voltage applied to the first end of the first energy storage sub-circuitry 1. The light-emission time control sub-circuitry 11 may control the first end of the light-emission time control sub-circuitry 11 to be electrically connected to, or electrically disconnected from, the second end of the light-emission time control sub-circuitry 11 under the control of the voltage applied to the first end of the first energy storage sub-circuitry 1.

In some embodiments of the present disclosure, the predetermined voltage V0 may be, but not limited to, 0V. In actual use, V0 may also be a positive or negative voltage, i.e., V0 may be set according to the practical need.

In some embodiments of the present disclosure, when the light-emission time control sub-circuitry 11 is turned off, it means that the first end and the second end of the light-emission time control sub-circuitry 11 are electrically disconnected from each other.

When the light-emission time control sub-circuitry 11 is turned on, it means that the first end and the second end of the light-emission time control sub-circuitry 11 are electrically connected to each other.

During the operation of the pixel driving circuit in some embodiments of the present disclosure, within the light-emission stage, the time control data voltage applied by DT may change, so as to control the light-emission time control sub-circuitry 11 from an on state to an off state, or from the off state to the on state, thereby to control a light-emission time of the light-emitting element 10.

At the light-emission stage, the time control data voltage applied by the time control data line may be equal to V0-Kt, where t represents a difference between a current time and a start time of the light-emission stage. The light-emission time control transistor of the light-emission time control sub-circuitry may be, but not limited to, a p-type transistor and K may be, but not limited to, a positive number, or the light-emission time control transistor of the light-emission time control sub-circuitry may be, but not limited to, an n-type transistor and K may be, but not limited to, a negative number.

Within the light-emission stage, the time control data voltage may change according to any other rule, so as to control the light-emission time of the light-emitting element.

During the implementation, the pixel driving circuit may further include a second light-emission control sub-circuitry electrically connected to the light-emission control line, the second end of the light-emission time control sub-circuitry and the output end, and configured to control the second end of the light-emission time control sub-circuitry to be electrically connected to the light-emitting element under the control of the light-emission control signal.

Figure 2:
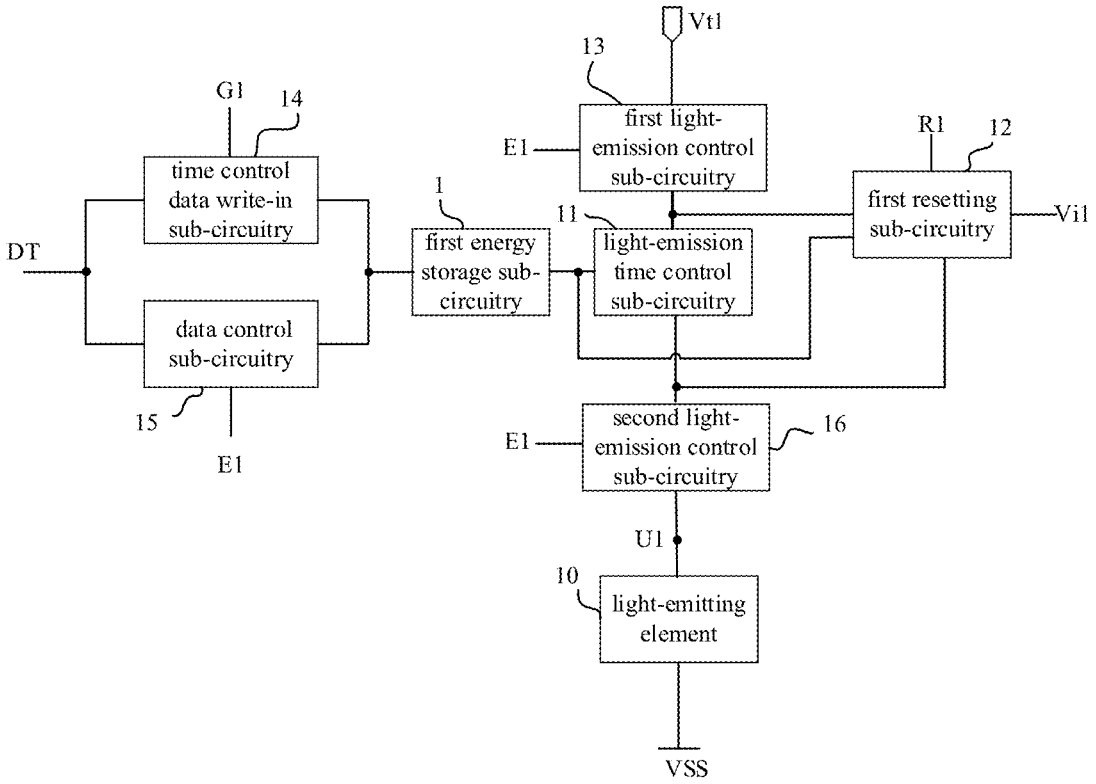
FIG. 2 is yet another schematic view showing the pixel driving circuit according to one embodiment of the present disclosure.

As shown in FIG. 2, on the basis of the pixel driving circuit in FIG. 1B, the pixel driving circuit may further include a second light-emission control sub-circuitry 16 electrically connected to the light-emission control line E1, the second end of the light-emission time control sub-circuitry 11 and the output end U1, and configured to control the second end of the light-emission time control sub-circuitry 11 to be electrically connected to the output end U1 under the control of the light-emission control signal.

In the embodiments of the present disclosure, through the additional second light-emission control sub-circuitry 16, it is able to control the second end of the light-emission time control sub-circuitry 11 to be electrically connected to, or electrically disconnected from, the first electrode of the light-emitting element 10 under the control of the light-emission control signal.

In the pixel driving circuit in FIG. 2, when VSS is greater than or equal to Vi1, the light-emitting element 10 may be in a reverse biased state within the resetting time period, and at this time the second light-emission control sub-circuitry 16 may be omitted. When VSS is smaller than Vi1, it is necessary to provide the second light-emission control sub-circuitry 16.

In a possible embodiment of the present disclosure, the light-emission time control sub-circuitry may include a light-emission time control transistor, a control electrode of which is the control end of the light-emission time control sub-circuitry, a first electrode of which is the first end of the light-emission time control sub-circuitry, and a second electrode of which is the second end of the light-emission time control sub-circuitry.

In a possible embodiment of the present disclosure, the first resetting sub-circuitry may include a first resetting transistor and a second resetting transistor. A control electrode of the first resetting transistor may be electrically connected to the resetting control line, a first electrode of the first resetting transistor may be electrically connected to the control end of the light-emission time control sub-circuitry, and a second electrode of the first resetting transistor may be electrically connected to the second end of the light-emission time control sub-circuitry. A control electrode of the second resetting transistor may be electrically connected to the resetting control line, a first electrode of the second resetting transistor may be electrically connected to the first end of the light-emission time control sub-circuitry, and a second electrode of the second resetting transistor may be electrically connected to the first initial voltage end for applying the first initial voltage.

In a possible embodiment of the present disclosure, the time control data write-in sub-circuitry may include a time control data write-in transistor, a control electrode of which is electrically connected to the first gate line, a first electrode of which is electrically connected to the time control data line, and a second electrode of which is electrically connected to the second end of the first energy storage sub-circuitry.

In a possible embodiment of the present disclosure, the data control sub-circuitry may include a data control transistor. A control electrode of the data control transistor may be electrically connected to the light-emission control line, a first electrode of the data control transistor may be electrically connected to the time control data line, and a second electrode of the data control transistor may be electrically connected to the second end of the first energy storage sub-circuitry.

In a possible embodiment of the present disclosure, the first light-emission control sub-circuitry may include a first light-emission control transistor, a control electrode of which is electrically connected to the light-emission control line, a first electrode of which is electrically connected to the first voltage end, and a second electrode of which is electrically connected to the first end of the light-emission time control sub-circuitry.

In a possible embodiment of the present disclosure, the second light-emission control sub-circuitry may include a second light-emission control transistor, a control electrode of which is electrically connected to the light-emission control line, a first electrode of which is electrically connected to the second end of the light-emission time control sub-circuitry, and a second electrode of which is electrically connected to the output end.

In some embodiments of the present disclosure, the light-emission time control sub-circuitry may include a light-emission time control transistor, the first resetting sub-circuitry may include a first resetting transistor and a second resetting transistor, the time control data write-in sub-circuitry may include a time control data write-in transistor, the data control sub-circuitry may include a data control transistor, the first light-emission control sub-circuitry includes a first light-emission control transistor, and the first energy storage sub-circuitry may include a time control capacitor.

A control electrode of the light-emission time control transistor may be the control end of the light-emission time control sub-circuitry, a first electrode of the light-emission time control transistor may be the first end of the light-emission time control sub-circuitry, and a second electrode of the light-emission time control transistor may be the second end of the light-emission time control sub-circuitry.

A control electrode of the first resetting transistor may be electrically connected to the resetting control line, a first electrode of the first resetting transistor may be electrically connected to the control end of the light-emission time control sub-circuitry, and a second electrode of the first resetting transistor may be electrically connected to the second end of the light-emission time control sub-circuitry.

A control electrode of the second resetting transistor may be electrically connected to the resetting control line, a first electrode of the second resetting transistor may be electrically connected to the first end of the light-emission time control sub-circuitry, and a second electrode of the second resetting transistor may be electrically connected to the first initial voltage end for applying the first initial voltage.

A control electrode of the time control data write-in transistor may be electrically connected to the first gate line, a first electrode of the time control data write-in transistor may be electrically connected to the time control data line, and a second electrode of the time control data write-in transistor may be electrically connected to the second end of the first energy storage sub-circuitry.

A control electrode of the data control transistor may be electrically connected to the light-emission control line, a first electrode of the data control transistor may be electrically connected to the time control data line, and a second electrode of the data control transistor may be electrically connected to the second end of the first energy storage sub-circuitry.

A control electrode of the first light-emission control transistor may be electrically connected to the light-emission control line, a first electrode of the first light-emission control transistor may be electrically connected to the first voltage end, and a second electrode of the first light-emission control transistor may be electrically connected to the first end of the light-emission time control sub-circuitry.

The first end of the first energy storage sub-circuitry may be a first end of the time control capacitor, and the second end of the first energy storage sub-circuitry may be a second end of the time control capacitor.

In a possible embodiment of the present disclosure, the pixel driving circuit may further include a second light-emission control sub-circuitry, and the second light-emission control sub-circuitry may include a second light-emission control transistor, a control electrode of which is electrically connected to the light-emission control line, a first electrode of which is electrically connected to the second end of the light-emission control sub-circuitry, and a second electrode of which is electrically connected to the output end.

Figure 3:
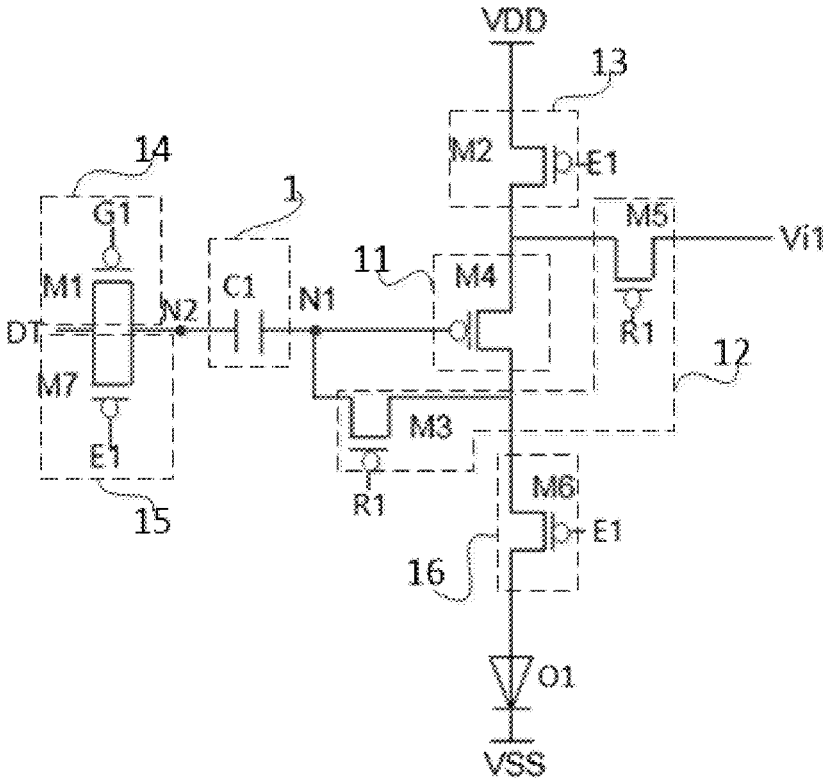
FIG. 3 is a circuit diagram of the pixel driving circuit according to one embodiment of the present disclosure.

As shown in FIG. 3, the pixel driving circuit is configured to drive a micro LED O1, and it may include the light-emission time control sub-circuitry 11, the first resetting sub-circuitry 12, the first light-emission control sub-circuitry 13, the time control data write-in sub-circuitry 14, the data control sub-circuitry 15, the second light-emission control sub-circuitry 16 and the first energy storage sub-circuitry 1.

The light-emission time control sub-circuitry 11 may include a light-emission time control transistor M4, the first resetting sub-circuitry 12 may include a first resetting transistor M3 and a second resetting transistor M5, the time control data write-in sub-circuitry 14 may include a time control data write-in transistor M1, the data control sub-circuitry 15 may include a data control transistor M7, the first light-emission control sub-circuitry 13 may include a first light-emission control transistor M2, the second light-emission control sub-circuitry 16 may include a second light-emission control transistor M6, and the first energy storage sub-circuitry 1 may include a time control capacitor C1.

A gate electrode of M3 may be electrically connected to the resetting control line R1, a source electrode of M3 may be electrically connected to a gate electrode of M4, and a drain electrode of M3 may be electrically connected to a drain electrode of M4.

A gate electrode of M5 may be electrically connected to the resetting control line R1, a source electrode of M5 may be electrically connected to a source electrode of M4, and a drain electrode of M5 may be electrically connected to the first initial voltage end for applying the first initial voltage Vi1.

A gate electrode of M1 may be electrically connected to the first gate line G1, a source electrode of M1 may be electrically connected to the time control data line DT, and a drain electrode of M1 may be electrically connected to a second end of C1.

A gate electrode of M7 may be electrically connected to the light-emission control line E1, a source electrode of M7 may be electrically connected to the time control data line DT, a drain electrode of M7 may be electrically connected to the second end of C1, and a first end of C1 may be electrically connected to the gate electrode of M4.

A gate electrode of M2 may be electrically connected to the light-emission control line E1, a source electrode of M2 may receive a first voltage VDD, and a drain electrode of M2 may be electrically connected to the source electrode of M4.

A gate electrode of M6 may be electrically connected to the light-emission control line E1, a source electrode of M6 may be electrically connected to the drain electrode of M4, a drain electrode of M6 may be electrically connected to an anode of O1, and a cathode of O1 may receive a low voltage VSS.

In FIG. 3, all the transistors may be, but not limited to, p-type TFTs.

In FIG. 3, N1 may be a first node connected to the gate electrode of M4, and N2 may be a second node connected to the second end of C1.

In FIG. 3, Vi1 may be, but not limited to, 0V. A value of Vi1 may be set according to the practical need.

In FIG. 3, the anode of O1 may be the first electrode of the light-emitting element, and the cathode of O1 may be the second electrode of the light-emitting element. In the pixel driving circuit in FIG. 3, when VSS is greater than or equal to Vi1, O1 may be in a reverse biased state within the resetting time period, and at this time M6 may be omitted. When VSS is smaller than Vi1, it is necessary to provide M6.

Figure 4:
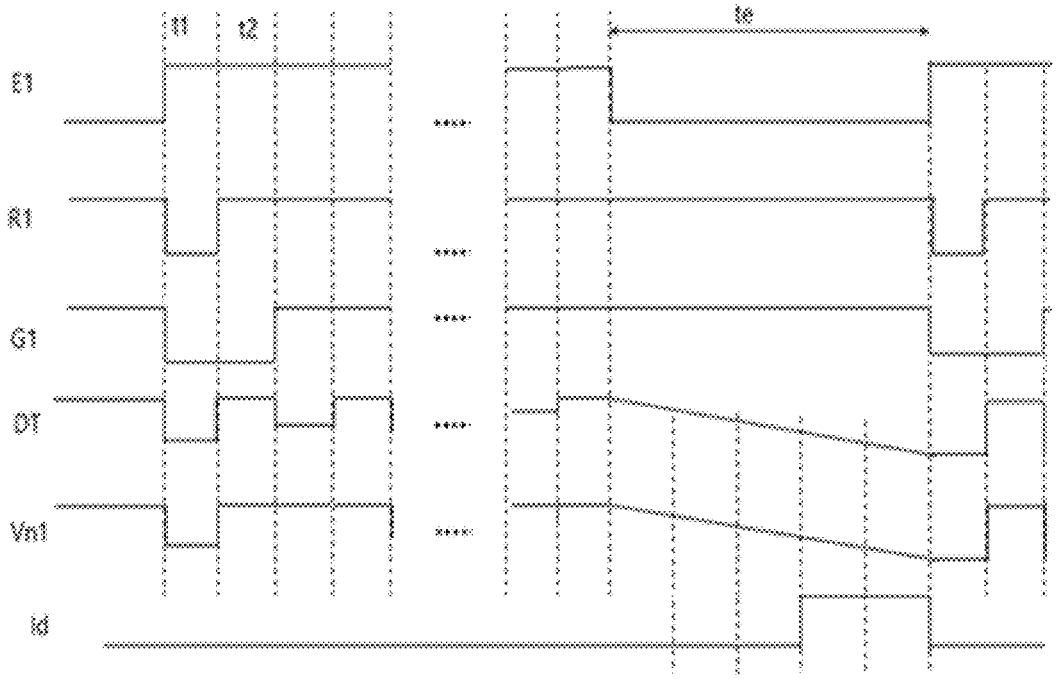
FIG. 4 is a sequence diagram of the pixel driving circuit in FIG. 3.

As shown in FIG. 4, during the operation of the pixel driving circuit in FIG. 3, a display period may include a resetting time period t1, a compensation time period t2 and a light-emission stage te.

Figure 5A:
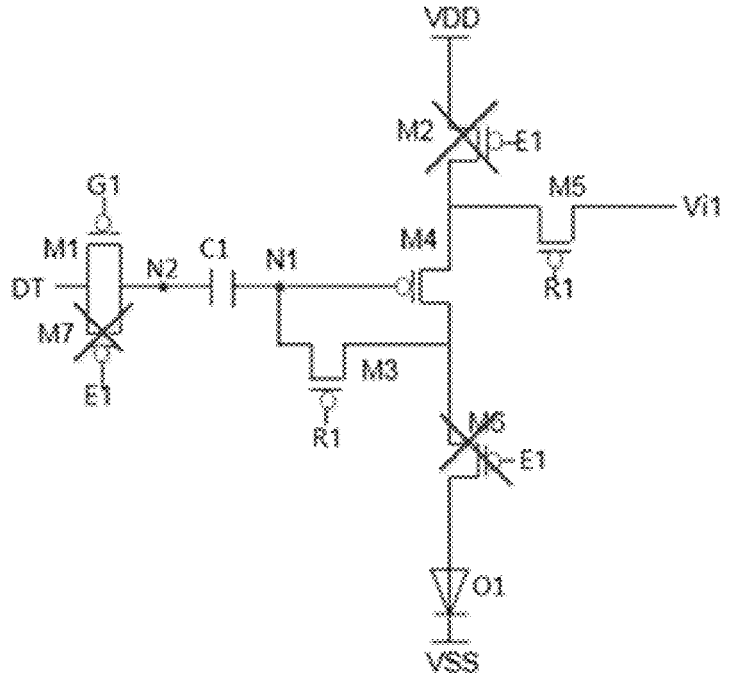
FIG. 5A is a schematic view showing an operating state of the pixel driving circuit in FIG. 3 within a resetting time period t1 according to one embodiment of the present disclosure.

Within the resetting time period t1, as shown in FIG. 5A, a high level may be applied to E1 so as to turn off M2, M6 and M7, a low level may be applied to R1 and G1 so as to turn on M1, M3, M4 and M5, and the predetermined time control data voltage VdT may be applied to DT, so a voltage of N2 may be equal to VdT and a voltage of the source electrode of M4 may be Vi1. At this time, M4 may be turned on to change a potential at the gate electrode of M4 until a potential at N1 is Vi1+Vth4, where Vth4 represents a threshold voltage of M4. Vi1 may be set as 0V, so the potential at N1 may be Vth4 and a potential at N2 may be VdT.

Figure 5B:
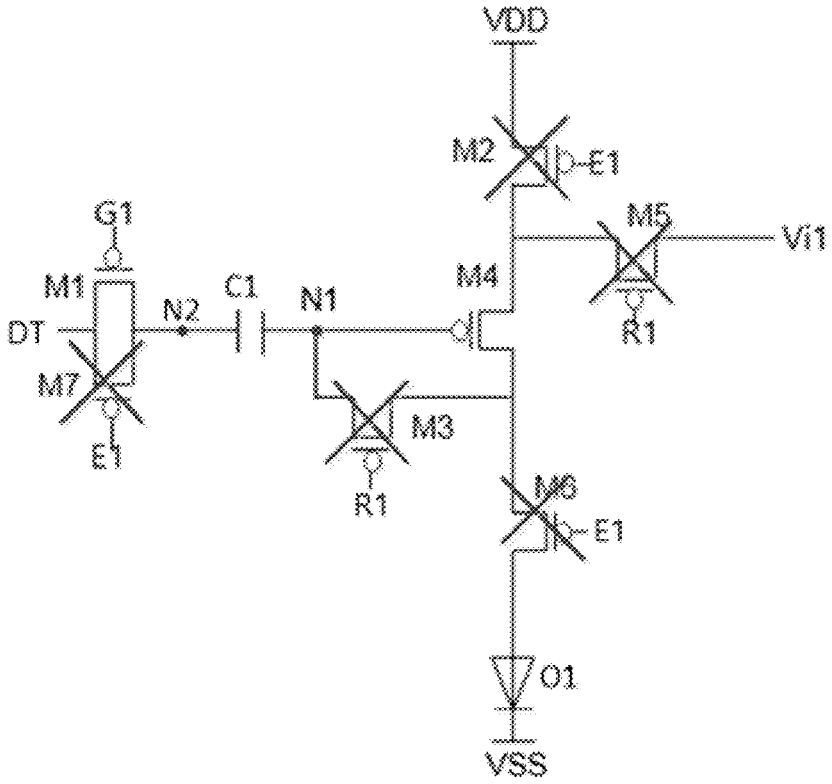
FIG. 5B is a schematic view showing an operating state of the pixel driving circuit in FIG. 3 within a compensation time period t2 according to one embodiment of the present disclosure.

Within the compensation time period t2, as shown in FIG. 5B, a high level may be applied to E1 to turn off M2, M6 and M7, a high level may be applied to R1 to turn off M3 and M5, and a data voltage of 0V may be applied to DT. Based on a principle of charge conservation, the potential at N2 may jump from VdT to 0V, so the potential at N1 may jump from Vth4 to Vth4−VdT. Under the control of the potential at N1, M4 may be turned off.

Figure 5C:
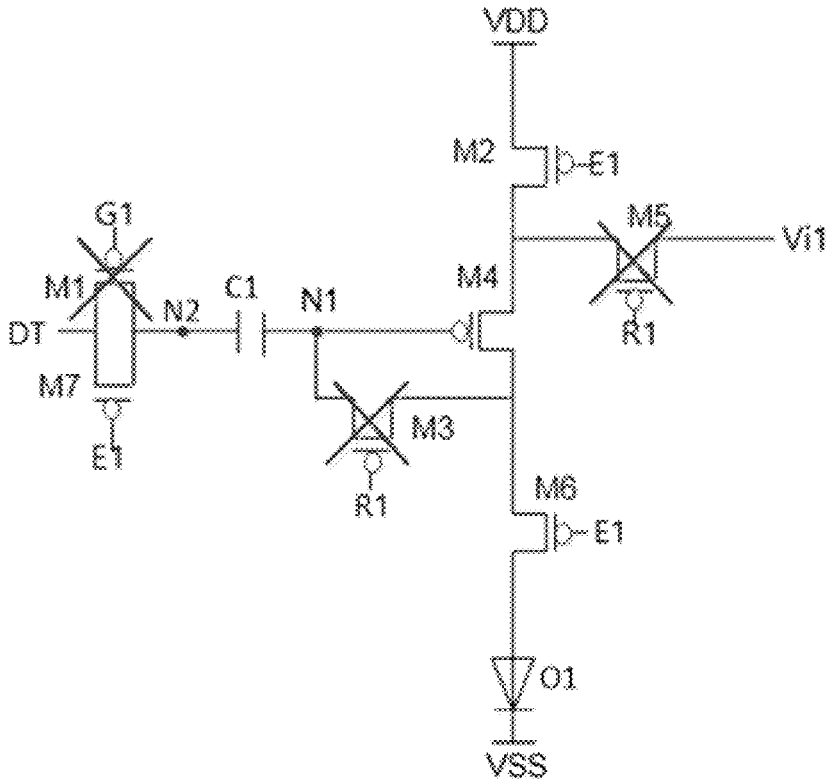
FIG. 5C is a schematic view showing an operating state of the pixel driving circuit in FIG. 3 within a light-emitting time period te according to one embodiment of the present disclosure.

At the light-emission stage te, as shown in FIG. 5C, a high level may be applied to G1 to turn off M1, a high level may be applied to R1 to maintain M3 and M5 to be each in an off state, and a low level may be applied to E1 to turn on M2, M6 and M7. At this time, FIG. 4 shows a waveform of the time control data voltage applied by DT. As shown in FIG. 4, the time control data voltage decreases at a constant slope from the voltage of 0V within the compensation time period t2 until the beginning of a next frame. A voltage value of the time control data voltage may be a predetermined voltage.

At the light-emission stage te, when the time control data voltage decreases from 0V to VdT, based on the principle of charge conversation, the potential at N1 may jump to Vth4, and a gate-to-source voltage Vgs4 may be equal to Vth4−VDD. VDD may be preferentially set as 0V or less, i.e., Vgs4>Vth4. At this time, M4 may be turned on. In other words, at the light-emission stage te, M4 may be switched from an off state to an on state, and a turn-on time of M4 may depend on VdT and a value of the time control data voltage within the light-emission stage te, i.e., the turn-on time of M4 may be independent of Vth4.

At the light-emission stage te, M4 may be in a fully on state and at a non-saturated region.

In FIG. 4, Id represents a driving current for driving O1 to emit light, and Vn1 represents the voltage of N1.

Figure 6:
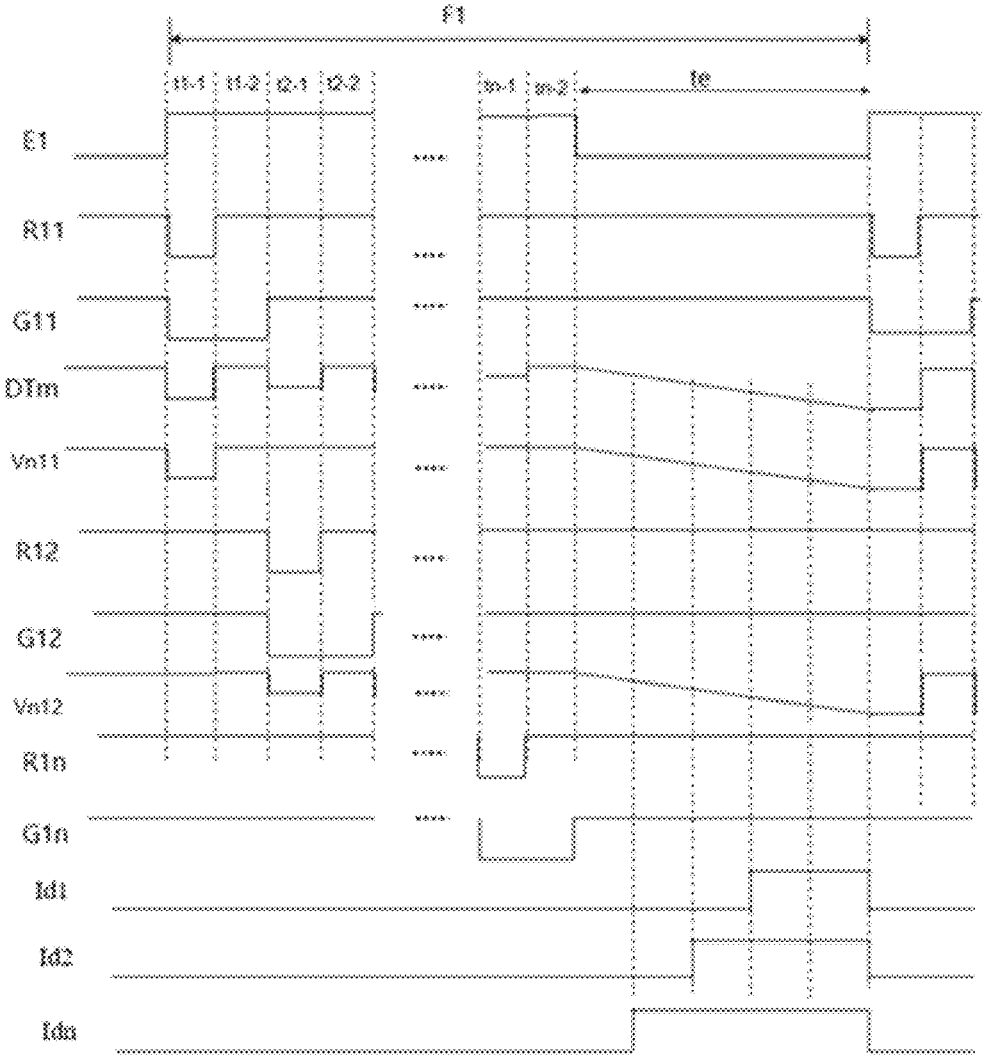
FIG. 6 is a sequence diagram of pixel driving circuits in rows according to one embodiments of the present disclosure.

In some embodiments of the present disclosure, a display panel may include the pixel driving circuits arranged in rows and columns. As shown in FIG. 6, one frame F1 may include a preparation stage and the light-emission stage to arranged one after another. The preparation stage may include a plurality of preparation time periods arranged one after another, and each preparation time period may include a resetting time period and a compensation time period arranged one after another.

In FIG. 6, t1-1 represents a first resetting time period, t1-2 represents a first compensation time period, t2-1 represents a second resetting time period, t2-2 represents a second compensation time period, tn-1 represents an $n^{th}$ resetting time period, tn-2 represents an $n^{th}$ compensation time period, E1 represents the light-emission control line, DTm represents an $m^{th}$ time control data line, R11 represents a first resetting control line, G11 represents a first gate line in a first row, R12 represents a second resetting control line, G12 represents a first gate line in a second row, Gln represents a first gate line in an $n^{th}$ row, R1*n* represents an $n^{th}$ resetting control line, Vn11 represents a potential at a first node N1 in a pixel driving circuit in a first row and an $m^{th}$ column, Vn12 represents a potential at a first node N1 in a pixel driving circuit in a second row and the $m^{th}$ column, Id1 represents a driving current for a micro LED in a first row and an $m^{th}$ column, Id2 represents a driving current for a micro LED in a second row and the $m^{th}$ column, and Idn represents a driving current for a micro LED in an $n^{th}$ row and the $m^{th}$ column, where m is a positive integer, and n is an integer greater than 2.

In some embodiments of the present disclosure, the pixel driving circuit in the first row and the $m^{t}$ column is configured to drive the micro LED in the first row and the $m^{th}$ column, the pixel driving circuit in the second row and the $m^{th}$ column is configured to drive the micro LED in the second row and the $m^{th}$ column, and the pixel driving circuit in the $n^{th}$ row and the $m^{th}$ column is configured to drive the micro LED in the $n^{th}$ row and the $m^{th}$ column.

As shown in FIG. 6, within t1-1, a first time control data voltage VdT1 may be written into DTm; within t1-2, a voltage of 0V may be written into DTm; within t2-1, a second time control data voltage VdT2 may be written into DTm; within t2-2, a voltage of 0V may be written into DTm; within tn-1, an $n^{th}$ time control data voltage VdTn may be written into DTm; and within tn-2, a voltage of 0V may be written into DTm. At te, the data voltage on DTm may decrease at a constant slope from 0V, so as to control the light-emission time of each micro LED.

In the related art, the micro LED has been considered as a next-generation display technology due to such characteristics as low driving voltage, ultra-high brightness, long service life and high temperature resistance. However, it is immature to transfer and bind the micro LED, and there is no corresponding glass-based driving back plate, so a micro-LED display panel has not been available in the market so far. In the embodiments of the present disclosure, a scheme for the glass-based driving back plate is presented, and the pixel driving circuit is mainly provided to solve such problems for the micro LED as chromaticity coordinate offset at different currents and unstable brightness at a low current density.

In the related art, usually the pixel driving circuit including the micro LED is arranged on a Printed Circuit Board (PCB) substrate. This is because, when the pixel driving circuit is formed on a glass substrate through a low-temperature polycrystalline silicon technology, a threshold voltage drift of the transistor may occur due to the low-temperature polycrystalline silicon technology, and thereby the luminous brightness may be adversely affected. However, through the pixel driving circuit in the embodiments of the present disclosure, it is able to compensate for the threshold voltage drift, thereby to provide the scheme for the glass-based driving back plate.

In the embodiments of the present disclosure, the pixel driving circuit may control a grayscale value through controlling the light-emission time at a constant current or constant voltage. In addition, the threshold voltage drift of the transistor due to the low-temperature polycrystalline silicon technology may be taken into consideration, i.e., the threshold voltage drift may be compensated. The light-emission time control transistor M4 may be turned on regardless of the threshold voltage, so it is able to accurately control the light-emission time in accordance with the time control data voltage and provide more grayscale values.

According to the pixel driving circuit in the embodiments of the present disclosure, the turn-on time of M4 and a time when the current flows to the micro LED may be controlled in accordance with the potential at N1, i.e., the brightness value may be determined in accordance with the time when the micro LED emits light within one frame.

According to the scheme for the glass-based driving back plate in the embodiments of the present disclosure, the pixel driving circuit is mainly provided to solve such problems for the micro LED as chromaticity coordinate offset at different currents and unstable brightness at a low current density. In the embodiments of the present disclosure, a new pixel driving circuit for the glass-based micro LED display panel has been presented, so as to control the grayscale values through controlling the light-emission time at a constant current or constant voltage.

Figure 7:
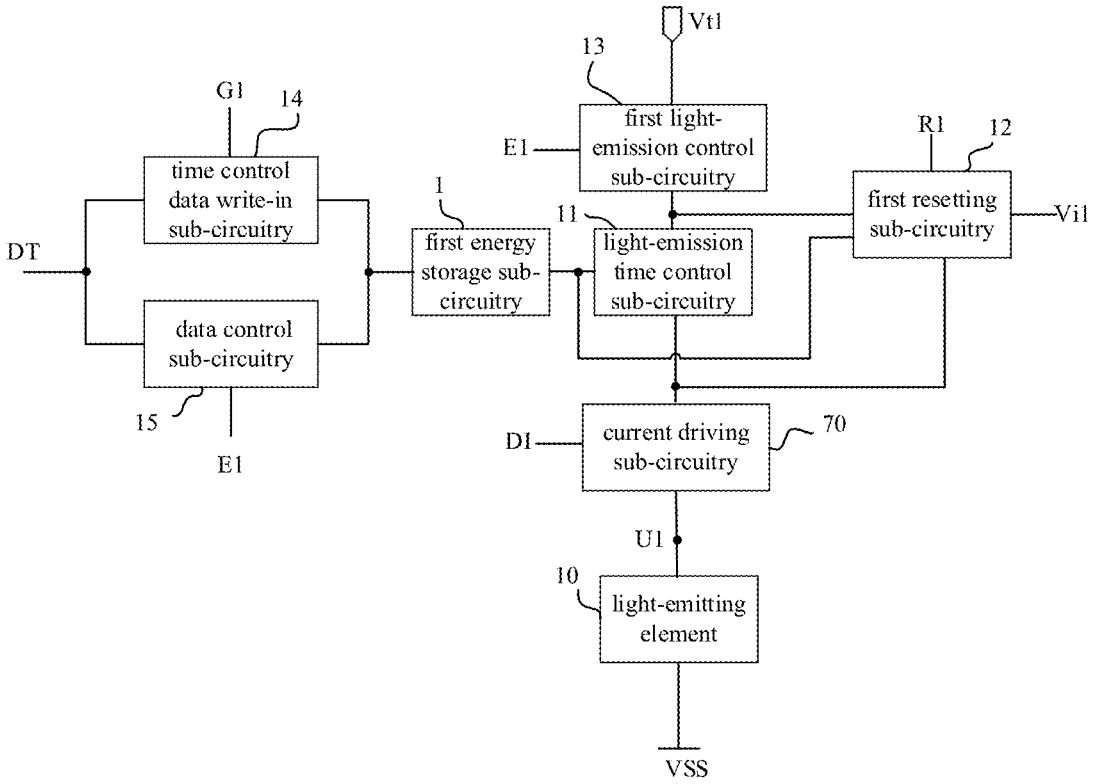
FIG. 7 is still yet another schematic view showing the pixel driving circuit according to one embodiment of the present disclosure.

As shown in FIG. 7, the pixel driving circuit is configured to drive the light-emitting element 10 to emit light, and it may include a current driving sub-circuitry 70, the light-emission time control sub-circuitry 11, the first energy storage sub-circuitry 1, the first resetting sub-circuitry 12, the first light-emission control sub-circuitry 13, the time control data write-in sub-circuitry 14 and the data control sub-circuitry 15.

The first resetting sub-circuitry 12 is electrically connected to the resetting control line R1, the first initial voltage end, and the first end, the control end and the second end of the light-emission time control sub-circuitry 11, and configured to write the first initial voltage Vi1 from the first initial voltage end into the first end of the light-emission time control sub-circuitry 11 under the control of the resetting control signal from the resetting control line R1, and control the control end of the light-emission time control sub-circuitry 11 to be electrically connected to the second end of the light-emission time control sub-circuitry 11 under the control of the resetting control signal.

The first end of the first energy storage sub-circuitry 1 is electrically connected to the control end of the light-emission time control sub-circuitry 11.

The time control data write-in sub-circuitry 14 is electrically connected to the first gate line G1, the time control data line DT and the second end of the first energy storage sub-circuitry 1, and configured to control the time control data line DT to be electrically connected to the second end of the first energy storage sub-circuitry 1 under the control of the first gate driving signal from the first gate line G1.

The data control sub-circuitry 15 is electrically connected to the light-emission control line E1, the time control data line DT and the second end of the first energy storage sub-circuitry 1, and configured to control the time control data line DT to be electrically connected to the second end of the first energy storage sub-circuitry 1 under the control of a light-emission control signal from the light-emission control line E1.

The first light-emission control sub-circuitry 13 is electrically connected to the light-emission control line E1, the first end of the light-emission time control sub-circuitry 11 and the first voltage end Vt1, and configured to control the first end of the light-emission time control sub-circuitry 11 to be electrically connected to the first voltage end Vt1 under the control of the light-emission control signal.

The second end of the light-emission time control sub-circuitry 11 is electrically connected to the first electrode of the light-emitting element 10, and the light-emission time control sub-circuitry 11 is configured to control the first end of the light-emission time control sub-circuitry 11 to be electrically connected to the second end of the light-emission time control sub-circuitry 11 under the control of a potential at the control end of the light-emission time control sub-circuitry 11.

The current driving sub-circuitry 70 is electrically connected to a current control data line DI, connected between the second end of the light-emission time control sub-circuitry 11 and the first electrode of the light-emitting element 10, and configured to generate a driving current for driving the light-emitting element 10 to emit light at the light-emission stage in accordance with the current control data voltage from the current control data line DI.

The first electrode of the light-emitting element 10 is electrically connected to the output end U1, and the second electrode of the light-emitting element 10 may receive a low voltage VSS.

During the operation of the pixel driving circuit in the embodiments of the present disclosure, the current driving sub-circuitry 70 may control a size of the driving current for driving the light-emitting element 10 to emit light, and the light-emission time control sub-circuitry 11, the first energy storage sub-circuitry 1, the first resetting sub-circuitry 12, the first light-emission control sub-circuitry 13, the time control data write-in sub-circuitry 14 and the data control sub-circuitry 15 may control the light-emission time of the light-emitting element 10.

During the operation of the pixel driving circuit in the embodiments of the present disclosure, the display period may include a resetting time period, a compensation time period and a light-emission stage.

Within the resetting time period, the first resetting sub-circuitry 12 may write the first initial voltage Vi1 into the first end of the light-emission time control sub-circuitry 11 and control the control end of the light-emission time control sub-circuitry 11 to be electrically connected to the second end of the light-emission time control sub-circuitry 11 under the control of the resetting control signal. The time control data write-in sub-circuitry 14 may write a predetermined time control data voltage VdT from the time control data line into the second end of the first energy storage sub-circuitry 1 under the control of the first gate driving signal. The light-emission time control sub-circuitry 11 may control the first end of the light-emission time control sub-circuitry 11 to be electrically connected to the second end of the light-emission time control sub-circuitry 11 under the control of the control end of the light-emission time control sub-circuitry 11. In this way, it is able to correspondingly change a voltage applied to the first end of the first energy storage sub-circuitry 1 until the light-emission time control sub-circuitry 11 has been turned off.

Within the compensation time period, the time control data write-in sub-circuitry 14 may write a predetermined voltage V0 from the time control data line DT into the second end of the first energy storage sub-circuitry 1 under the control of the first gate driving signal from the first gate line G1, so as to correspondingly change the voltage applied to the first end of the first energy storage sub-circuitry 1.

At the light-emission stage, the current driving sub-circuitry 70 may generate the driving current for driving the light-emitting element 10 to emit light in accordance with the current control data voltage across the current control data line DI, the first light-emission control sub-circuitry 13 may control the first end of the light-emission time control sub-circuitry 11 to be electrically connected to the first voltage end Vt1 under the control of the light-emission control signal, the data control sub-circuitry 15 may control the time control data line DT to be electrically connected to the second end of the first energy storage sub-circuitry 1 under the control of the light-emission control signal from the light-emission control line E1, so as to correspondingly change the voltage applied to the first end of the first energy storage sub-circuitry 1. The light-emission time control sub-circuitry 11 may control the first end of the light-emission time control sub-circuitry 11 to be electrically connected to, or electrically disconnected from, the second end of the light-emission time control sub-circuitry 11 under the control of the voltage applied to the first end of the first energy storage sub-circuitry 1.

In a possible embodiment of the present disclosure, the current driving sub-circuitry may include a driving sub-circuitry, a current control data write-in sub-circuitry, a second resetting sub-circuitry, a compensation sub-circuitry and a second energy storage sub-circuitry. A first end of the driving sub-circuitry may be electrically connected to the second end of the light-emission time control sub-circuitry, a second end of the driving sub-circuitry may be electrically connected to the output end, and the driving sub-circuitry is configured to control the first end of the driving sub-circuitry to be electrically connected to the second end of the driving sub-circuitry under the control of a potential at a control end of the driving sub-circuitry. A first end of the second energy storage sub-circuitry may be electrically connected to the control end of the driving sub-circuitry, a second end of the second energy storage sub-circuitry may be electrically connected to a second voltage end, and the second energy storage sub-circuitry is configured to store a voltage. The current control data write-in sub-circuitry may be electrically connected to a second gate line, the current control data line and the first end of the driving sub-circuitry, and configured to control the current control data line to be electrically connected to the first end of the driving sub-circuitry under the control of a second gate driving signal from the second gate line. The second resetting sub-circuitry may be electrically connected to the resetting control line, a second initial voltage end and the control end of the driving sub-circuitry, and configured to apply a second initial voltage from the second initial voltage end to the control end of the driving sub-circuitry under the control of the resetting control signal from the resetting control line. The compensation sub-circuitry may be electrically connected to the second gate line, the control end of the driving sub-circuitry and the second end of the driving sub-circuitry, and configured to control the control end of the driving sub-circuitry to be electrically connected to the second end of the driving sub-circuitry under the control of the second gate driving signal.

In some embodiments of the present disclosure, the first energy storage sub-circuitry may include a time control capacitor, and the second energy storage sub-circuitry may include a current control capacitor.

Figure 8:
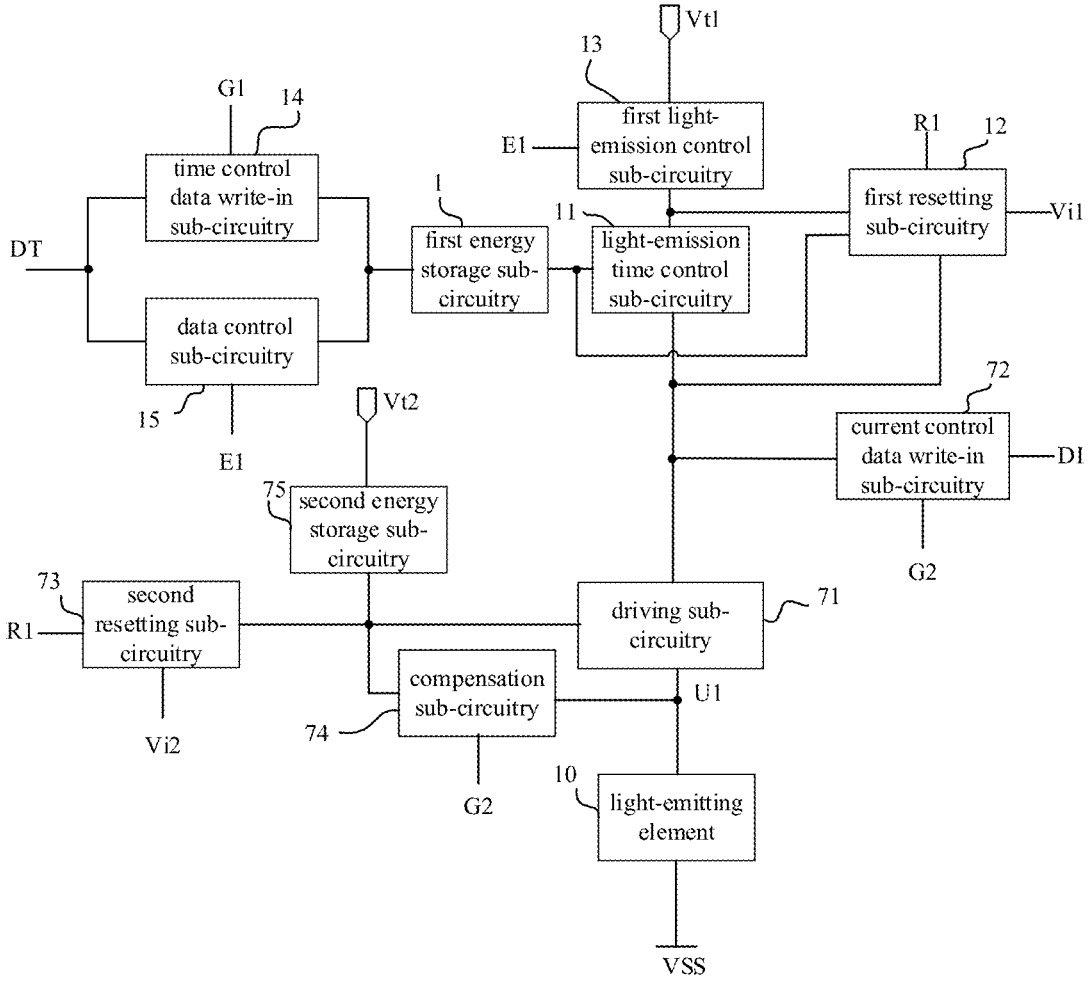
FIG. 8 is still yet another schematic view showing the pixel driving circuit according to one embodiment of the present disclosure.

As shown in FIG. 8, on the basis of the pixel driving circuit in FIG. 7, the current driving sub-circuitry may include a driving sub-circuitry 71, a current control data write-in sub-circuitry 72, a second resetting sub-circuitry 73, a compensation sub-circuitry 74 and a second energy storage sub-circuitry 75.

A first end of the driving sub-circuitry 71 may be electrically connected to the second end of the light-emission time control sub-circuitry 11, a second end of the driving sub-circuitry 71 may be electrically connected to the first electrode of the light-emitting element 10, and the driving sub-circuitry 71 is configured to control the first end of the driving sub-circuitry 71 to be electrically connected to the second end of the driving sub-circuitry 71 under the control of a potential at a control end of the driving sub-circuitry 71.

A first end of the second energy storage sub-circuitry 75 may be electrically connected to the control end of the driving sub-circuitry 71, a second end of the second energy storage sub-circuitry 75 may be electrically connected to a second voltage end Vt2.

The current control data write-in sub-circuitry 72 may be electrically connected to a second gate line G2, the current control data line DI and the first end of the driving sub-circuitry 71, and configured to control the current control data line DI to be electrically connected to the first end of the driving sub-circuitry 71 under the control of a second gate driving signal from the second gate line G2.

The second resetting sub-circuitry 73 may be electrically connected to the resetting control line R1, a second initial voltage end and the control end of the driving sub-circuitry 71, and configured to apply a second initial voltage Vi2 from the second initial voltage end to the control end of the driving sub-circuitry under the control of the resetting control signal from the resetting control line R1.

The compensation sub-circuitry 74 may be electrically connected to the second gate line G2, the control end of the driving sub-circuitry 71 and the second end of the driving sub-circuitry 71, and configured to control the control end of the driving sub-circuitry 71 to be electrically connected to the second end of the driving sub-circuitry 71 under the control of the second gate driving signal.

In some embodiments of the present disclosure, the second voltage end may be, but limited to, the same as the first voltage end. In actual use, the second voltage end may also be different from the first voltage end.

During the operation of the pixel driving circuit in FIG. 8, within the resetting time period, the second resetting sub-circuitry 73 may apply the second initial voltage Vi2 to the control end of the driving sub-circuitry 71 under the control of the resetting control signal, so as to enable the first end and the second end of the driving sub-circuitry 71 to be electrically disconnected from each other under the control of the potential at the control end of the driving sub-circuitry 71.

Within the compensation time period, the current control data write-in sub-circuitry 72 may write the predetermined current control data voltage VdI from the current control data line DI into the first end of the driving sub-circuitry 71 under the control of the second gate driving signal from the second gate line G2. The compensation sub-circuitry 74 may control the control end of the driving sub-circuitry 71 to be electrically connected to the second end of the driving sub-circuitry 71 under the control of the second gate driving signal, so as to enable the first end and the second end of the driving sub-circuitry 71 to be electrically connected to each other under the control of the potential at the content end of the driving sub-circuitry 71, thereby to correspondingly change the potential at the control end of the driving sub-circuitry 71 until the driving sub-circuitry 71 has been turned off.

At the light-emission stage, the driving sub-circuitry 71 may generate the driving current under the control of the potential at the control end of the driving sub-circuitry 71, so as to drive the light-emitting element 10 to emit light.

In a possible embodiment of the present disclosure, the pixel driving circuit may further include a second light-emission control sub-circuitry through which the first end of the driving sub-circuitry is electrically connected to the second end of the light-emission time control sub-circuitry. A control end of the second light-emission control sub-circuitry may be electrically connected to the light-emission control line, a first end of the second light-emission control sub-circuitry may be electrically connected to the second end of the light-emission time control sub-circuitry, and a second end of the second light-emission control sub-circuitry may be electrically connected to the driving sub-circuitry. The second light-emission control sub-circuitry is configured to control the second end of the light-emission time control sub-circuitry to be electrically connected to the driving sub-circuitry under the control of the light-emission control signal from the light-emission control line.

In a possible embodiment of the present disclosure, the pixel driving circuit may further include a third light-emission control sub-circuitry through which the second end of the driving sub-circuitry is electrically connected to the output end. The third light-emission control sub-circuitry is configured to control the second end of the driving sub-circuitry to be electrically connected to the output end under the control of the light-emission control signal from the light-emission control line.

Figure 9:
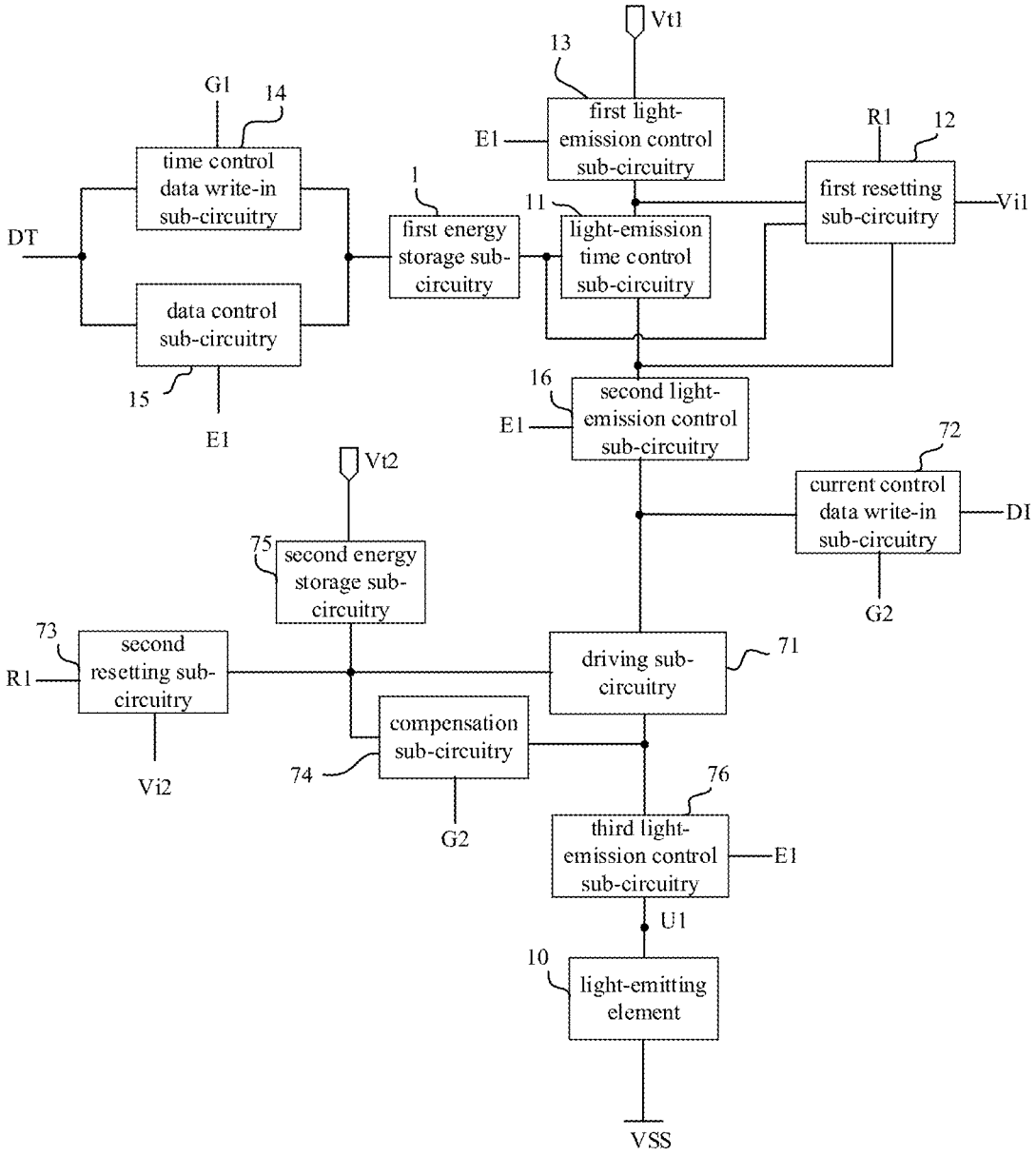
FIG. 9 is still yet another schematic view showing the pixel driving circuit according to one embodiment of the present disclosure.

As shown in FIG. 9, on the basis of the pixel driving circuit in FIG. 8, the pixel driving circuit may further include a second light-emission control sub-circuitry 16 and a third light-emission control sub-circuitry 76.

The first end of the driving sub-circuitry 71 may be electrically connected to the second end of the light-emission time control sub-circuitry 11 through the second light-emission control sub-circuitry 16. A control end of the second light-emission control sub-circuitry 16 may be electrically connected to the light-emission control line E1, a first end of the second light-emission control sub-circuitry 16 may be electrically connected to the second end of the light-emission time control sub-circuitry 11, and a second end of the second light-emission control sub-circuitry 16 may be electrically connected to the first end of the driving sub-circuitry 71. The second light-emission control sub-circuitry 16 is configured to control the second end of the light-emission time control sub-circuitry 11 to be electrically connected to first end of the driving sub-circuitry 71 under the control of the light-emission control signal from the light-emission control line E1.

The second end of the driving sub-circuitry 71 may be electrically connected to the first electrode of the light-emitting element 10 through the third light-emission control sub-circuitry 76. The second electrode of the light-emitting element 10 may receive the low voltage VSS, and the first electrode of the light-emitting element 10 may be electrically connected to the output end U1. The third light-emission control sub-circuitry 76 may be electrically connected to the light-emission control line E1, and the third light-emission control sub-circuitry is configured to control the second end of the driving sub-circuitry 71 to be electrically connected to the first electrode of the light-emitting element 10 under the control of the light-emission control signal from the light-emission control line E1.

During the operation of the pixel driving circuit in FIG. 9, at the light-emission stage, the second light-emission control sub-circuitry 16 may control the first end and the second end of the second light-emission control sub-circuitry 16 to be electrically connected to each other under the control of the light-emission control signal, and the third light-emission control sub-circuitry 76 may control the second end of the driving sub-circuitry 71 to be electrically connected to the first electrode of the light-emitting element 10.

In a possible embodiment of the present disclosure, the second energy storage sub-circuitry may include a current control capacitor. The first end of the second energy storage sub-circuitry may be, but not limited to, a first end of the current control capacitor, and the second end of the second energy storage sub-circuitry may be, but not limited to, a second end of the current control capacitor.

In a possible embodiment of the present disclosure, the driving sub-circuitry may include a driving transistor, a control electrode of which is electrically connected to the first end of the current control capacitor, a first electrode of which is electrically connected to the second end of the light-emission time control sub-circuitry, and a second electrode of which is electrically connected to the output end.

In a possible embodiment of the present disclosure, the current control data write-in sub-circuitry may include a current control data write-in transistor, a control electrode of which is electrically connected to the second gate line, a first electrode of which is electrically connected to the current control data line, and a second electrode of which is electrically connected to the first end of the driving sub-circuitry.

In a possible embodiment of the present disclosure, the second resetting sub-circuitry may include a third resetting transistor, a control electrode of which is electrically connected to the resetting control line, a first electrode of which is electrically connected to the second initial voltage end, and a second electrode of which is electrically connected to the control end of the driving sub-circuitry.

In a possible embodiment of the present disclosure, the compensation sub-circuitry may include a compensation transistor, a control electrode of which is electrically connected to the second gate line, a first electrode of which is electrically connected to the control end of the driving sub-circuitry, and a second electrode of which is electrically connected to the second end of the driving sub-circuitry.

In a possible embodiment of the present disclosure, the third light-emission control sub-circuitry may include a third light-emission control transistor, a control electrode of which is electrically connected to the light-emission control line, a first electrode of which is electrically connected to the second end of the driving sub-circuitry, and a second electrode of which is electrically connected to the output end.

Figure 10:
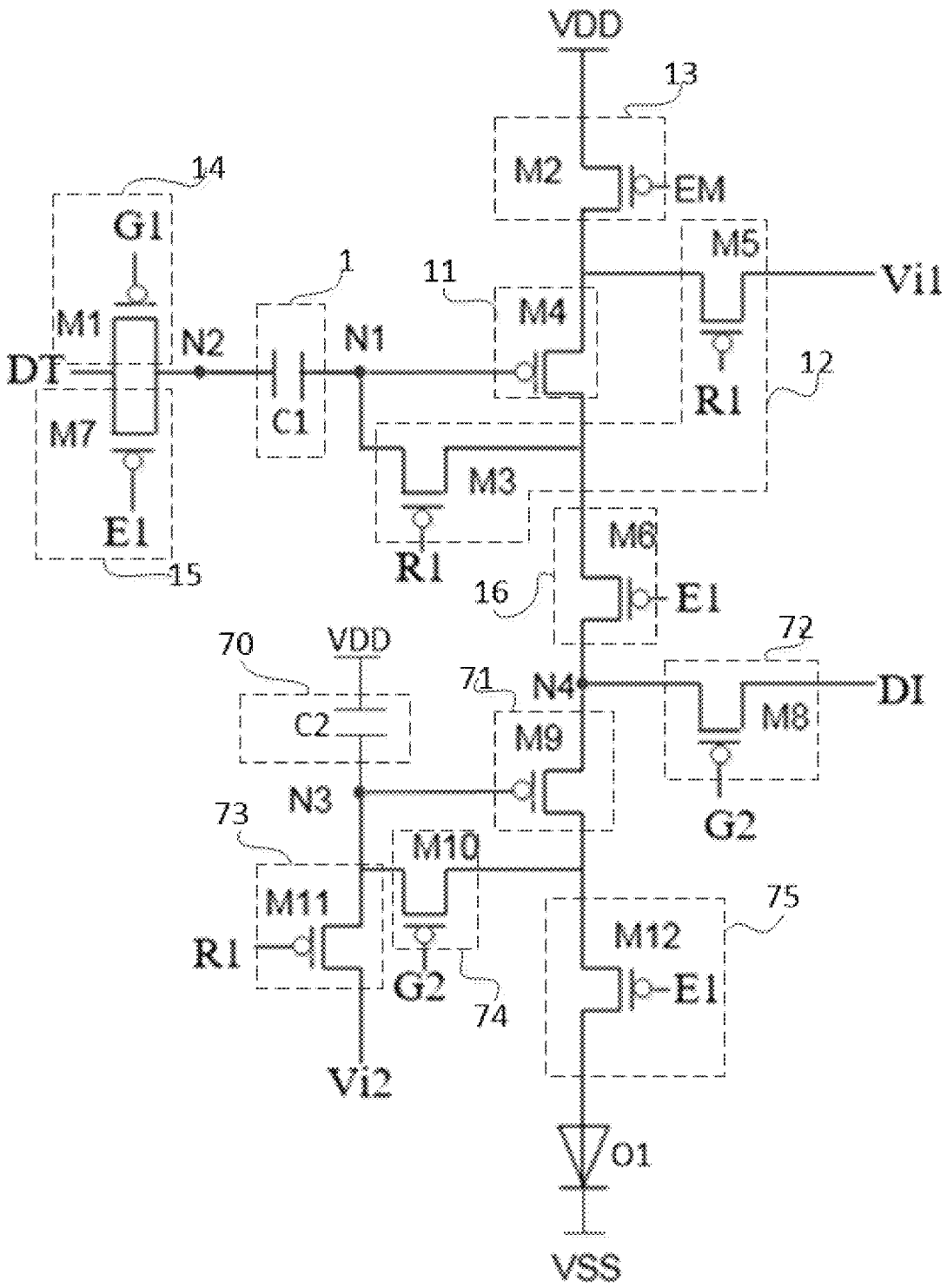
FIG. 10 is another circuit diagram of the pixel driving circuit according to one embodiment of the present disclosure.

As shown in FIG. 10, the pixel driving circuit is configured to drive the micro LED O1 to emit light, and it may include a current driving sub-circuitry, the light-emission time control sub-circuitry 11, the first energy storage sub-circuitry 1, the first resetting sub-circuitry 12, the first light-emission control sub-circuitry 13, the time control data write-in sub-circuitry 14, the data control sub-circuitry 15 and the second light-emission control sub-circuitry 16.

The light-emission time control sub-circuitry 11 may include a light-emission time control transistor M4, the first resetting sub-circuitry 12 may include a first resetting transistor M3 and a second resetting transistor M5, the time control data write-in sub-circuitry 14 may include a time control data write-in transistor M1, the data control sub-circuitry 15 may include a data control transistor M7, the first light-emission control sub-circuitry 13 may include a first light-emission control transistor M2, the second light-emission control sub-circuitry 16 may include a second light-emission control transistor M6, and the first energy storage sub-circuitry 1 may include a time control capacitor C1.

A gate electrode of M3 may be electrically connected to the resetting control line R1, a source electrode of M3 may be electrically connected to a gate electrode of M4, and a drain electrode of M3 may be electrically connected to a drain electrode of M4.

A gate electrode of M5 may be electrically connected to the resetting control line R1, a source electrode of M5 may be electrically connected to a source electrode of M4, and a drain electrode of M5 may be electrically connected to the first initial voltage end for applying the first initial voltage Vi1.

A gate electrode of M1 may be electrically connected to the first gate line G1, a source electrode of M1 may be electrically connected to the time control data line DT, a drain electrode of M1 may be electrically connected to a second end of C1, and a first end of C1 may be electrically connected to the gate electrode of M4.

A gate electrode of M7 may be electrically connected to the light-emission control line E1, a source electrode of M7 may be electrically connected to the time control data line DT, and a drain electrode of M7 may be electrically connected to the second end of C1.

A gate electrode of M2 may be electrically connected to the light-emission control line E1, a source electrode of M2 may receive a first voltage VDD, and a drain electrode of M2 may be electrically connected to the source electrode of M4.

A gate electrode of M6 may be electrically connected to the light-emission control line E1, a source electrode of M6 may be electrically connected to the drain electrode of M4, and a cathode of O1 may receive a low voltage VSS.

The current driving sub-circuitry may include a driving sub-circuitry 71, a current control data write-in sub-circuitry 72, a second resetting sub-circuitry 73, a compensation sub-circuitry 74, a third light-emission control sub-circuitry 76 and a second energy storage sub-circuitry 75.

The second energy storage sub-circuitry 75 may include a current control capacitor C2. The driving sub-circuitry 71 may include a driving transistor M9, a gate electrode of which is electrically connected to a first end of C2, and a source electrode of which is electrically connected to the drain electrode of M6.

The current control data write-in sub-circuitry 72 may include a current control data write-in transistor M8, a gate electrode of which is electrically connected to the second gate line G2, a source electrode of which is electrically connected to the current control data line DI, and a drain electrode of which is electrically connected to a source electrode of M9.

The second resetting sub-circuitry 73 may include a third resetting transistor M11, a gate electrode of which is electrically connected to the resetting control line R1, a source electrode of which is electrically connected to the second initial voltage end, and a drain electrode of which is electrically connected to the gate electrode of M9. The second initial voltage end is configured to apply the second initial voltage Vi2.

The compensation sub-circuitry 74 may include a compensation transistor M10, a gate electrode of which is electrically connected to the second gate line G2, a source electrode of which is electrically connected to the gate electrode of M9, and a drain electrode of which is electrically connected to a drain electrode of M9.

The third light-emission control sub-circuitry 76 may include a third light-emission control transistor M12, a gate electrode of which is electrically connected to the light-emission control line E1, a source electrode of which is electrically connected to the drain electrode of M9, and a drain electrode of which is electrically connected to an anode of the micro LED O1. The first end of C2 may be electrically connected to the gate electrode of M9, and a second end of C2 may receive the first voltage VDD.

In the pixel driving circuit in FIG. 10, all the transistors may be, but not limited to, p-type TFTs, and the first voltage end may be, but not limited to, the same as the second voltage end.

In FIG. 10, N1 represents a first node electrically connected to the gate electrode of M4, N2 represents a second node electrically connected to the second end of C1, N3 represents a third node electrically connected to the gate electrode of M9, and N4 represents a fourth node electrically connected to the source electrode of M9. In the pixel driving circuit in FIG. 10, M6 may be omitted.

In the pixel driving circuit in FIG. 10, when VdI is smaller than or equal to VSS, M12 may be omitted, and when VdI is greater than VSS, M12 may not be omitted.

During the operation of the pixel driving circuit in FIG. 10, within the compensation time period t2, when M12 is not provided and VdI is smaller than or equal to VSS, O1 may operate in a reverse biased state, so M12 may be omitted. When VdI is greater than VSS, M12 may not be omitted.

Figure 11:
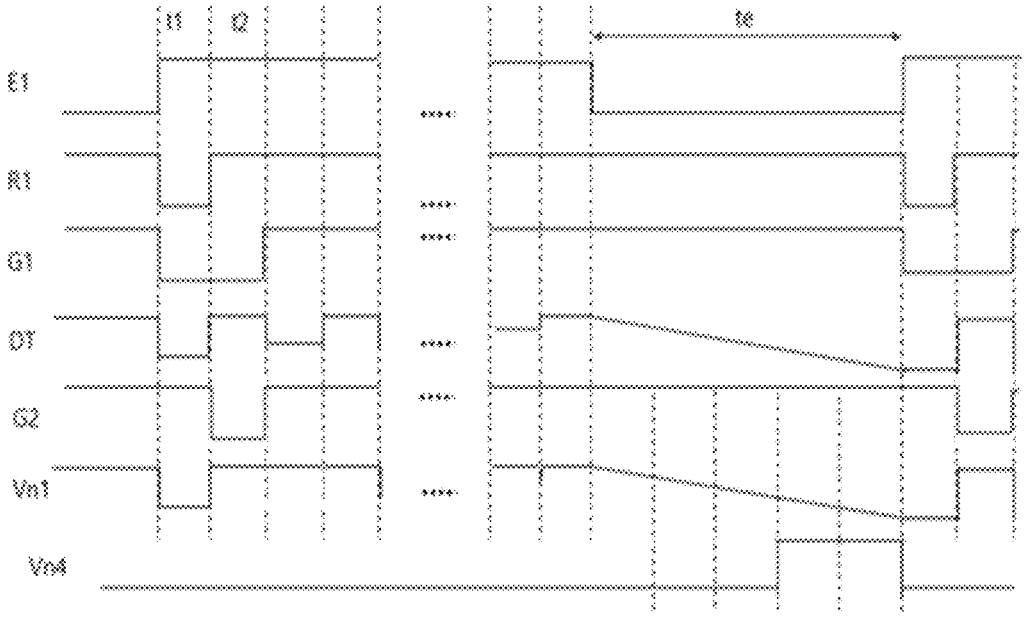
FIG. 11 is a sequence diagram of the pixel driving circuit in FIG. 10.

As shown in FIG. 11, during the operation of the pixel driving circuit in FIG. 10, a display period may include a resetting time period t1, a compensation time period t2 and a light-emission stage te.

Figure 12A:
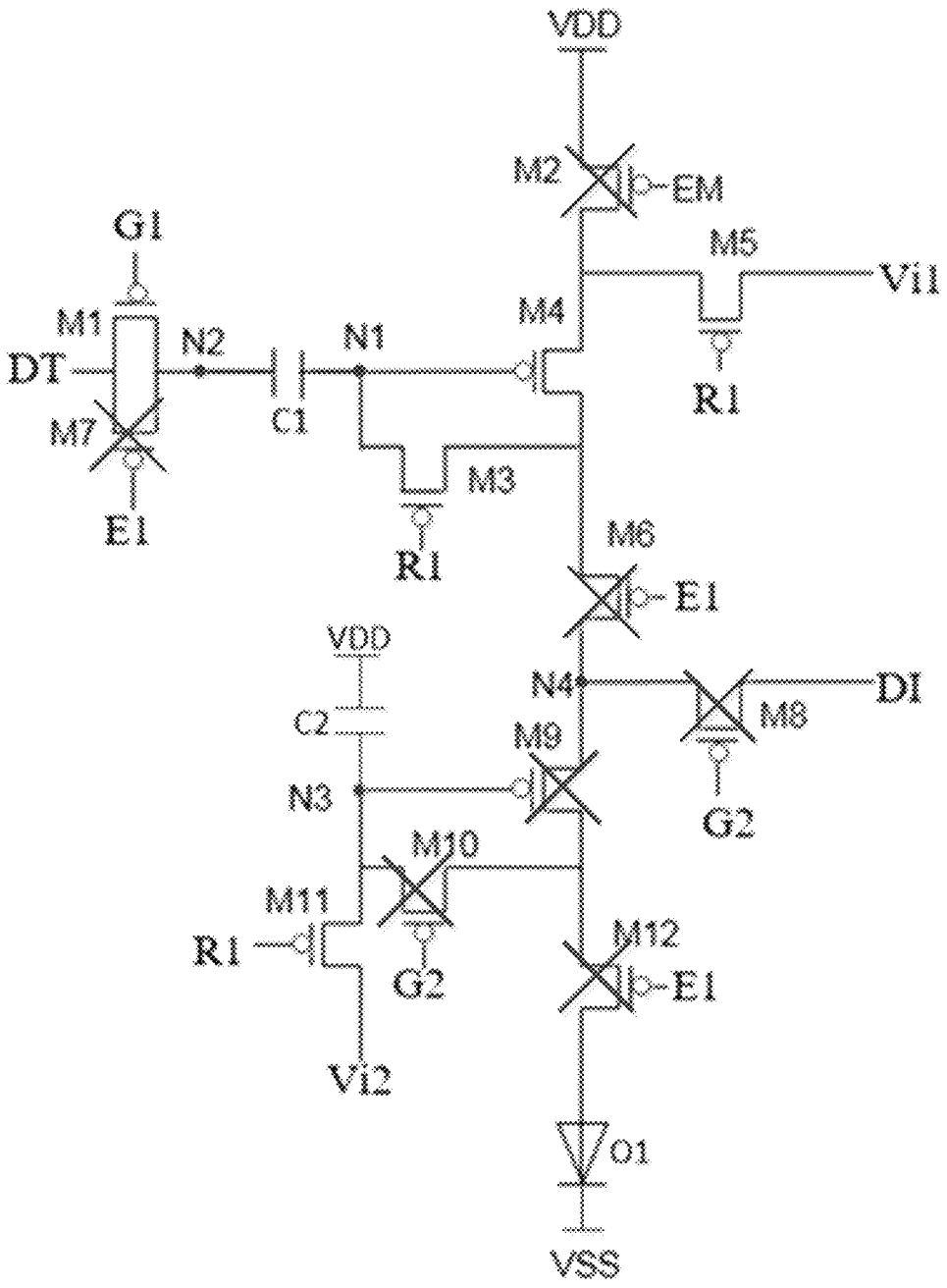
FIG. 12A is a schematic view showing an operating state of the pixel driving circuit in FIG. 10 within the resetting time period t1 according to one embodiment of the present disclosure.

Within the resetting time period t1, as shown in FIG. 12A, a high level may be applied to E1 so as to turn off M2, M6, M7, M8, M9, M10 and M12, a low level may be applied to R1 and G1 so as to turn on M1, M3, M4, M5 and M11, and the predetermined time control data voltage VdT may be applied to DT, so a voltage of N2 may be equal to VdT and a voltage of the source electrode of M4 may be Vi1. At this time, M4 may be turned on to change the potential at the gate electrode of M4 until a potential at N1 is Vi1+Vth4, where Vth4 represents a threshold voltage of M4. Vi1 may be set as 0V, so the potential at N1 may be Vth4 and a potential at N2 may be VdT. A voltage of N3 may be Vi2, and Vi2 may also be set as 0V.

Figure 12B:
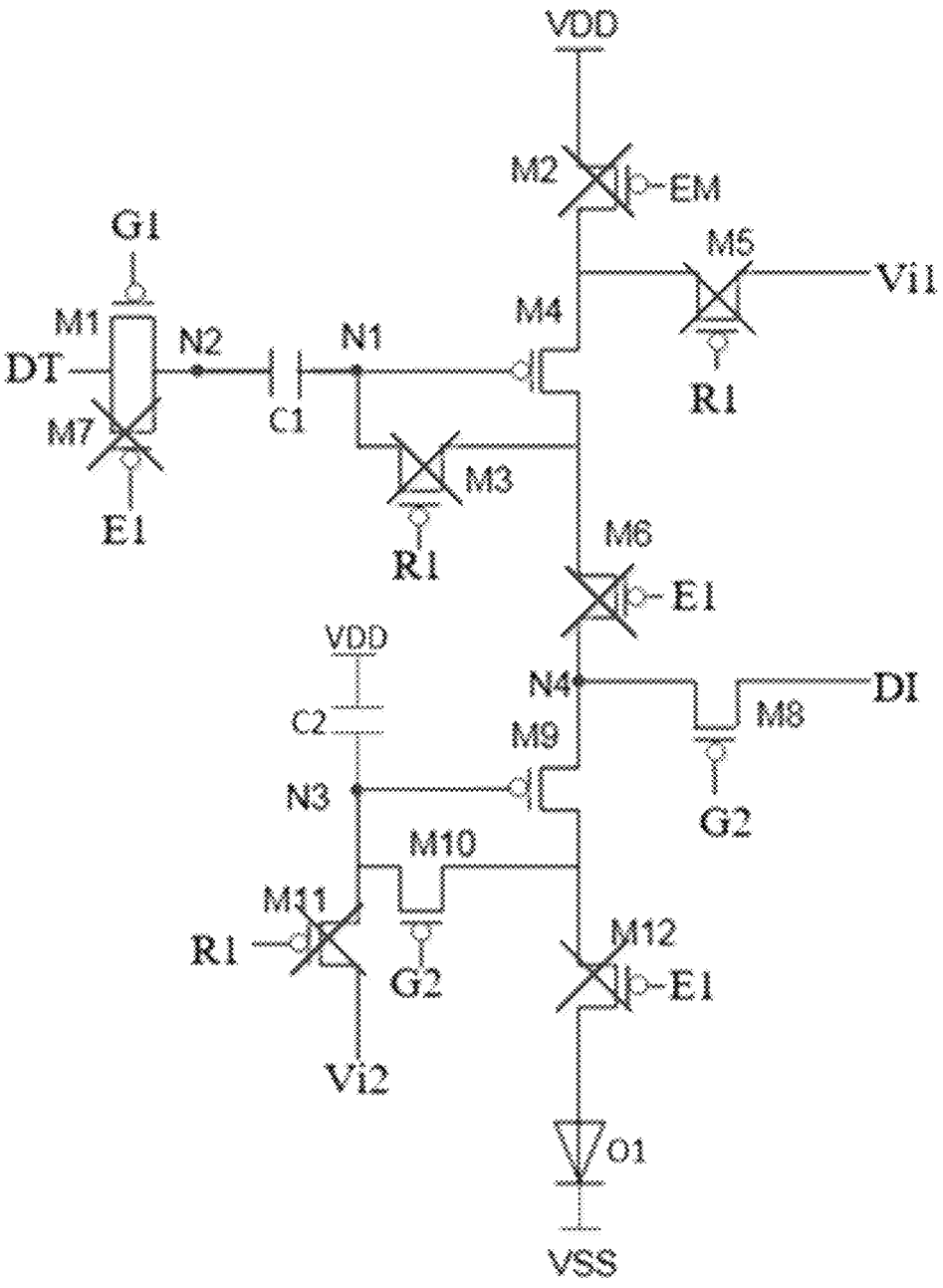
FIG. 12B is a schematic view showing an operating state of the pixel driving circuit in FIG. 10 within the compensation time period t2 according to one embodiment of the present disclosure.

Within the compensation time period t2, as shown in FIG. 12B, a high level may be applied to E1 to turn off M2, M6 and M7, a high level may be applied to R1 to turn off M3, M5 and M11, and a data voltage of 0V may be applied to DT. Based on a principle of charge conservation, the potential at N2 may jump from VdT to 0V, so the potential at N1 may jump from Vth4 to Vth4−VdT. In addition, a low level may be applied to G2 so as to turn on M8 and M10. M9 may be turned on, so as to change the voltage of N3 until M9 is turned off. At this time, the voltage of N3 may be maintained as VdI+Vth0 due to the effect of C2, where Vth9 represents a threshold voltage of M9.

Figure 12C:
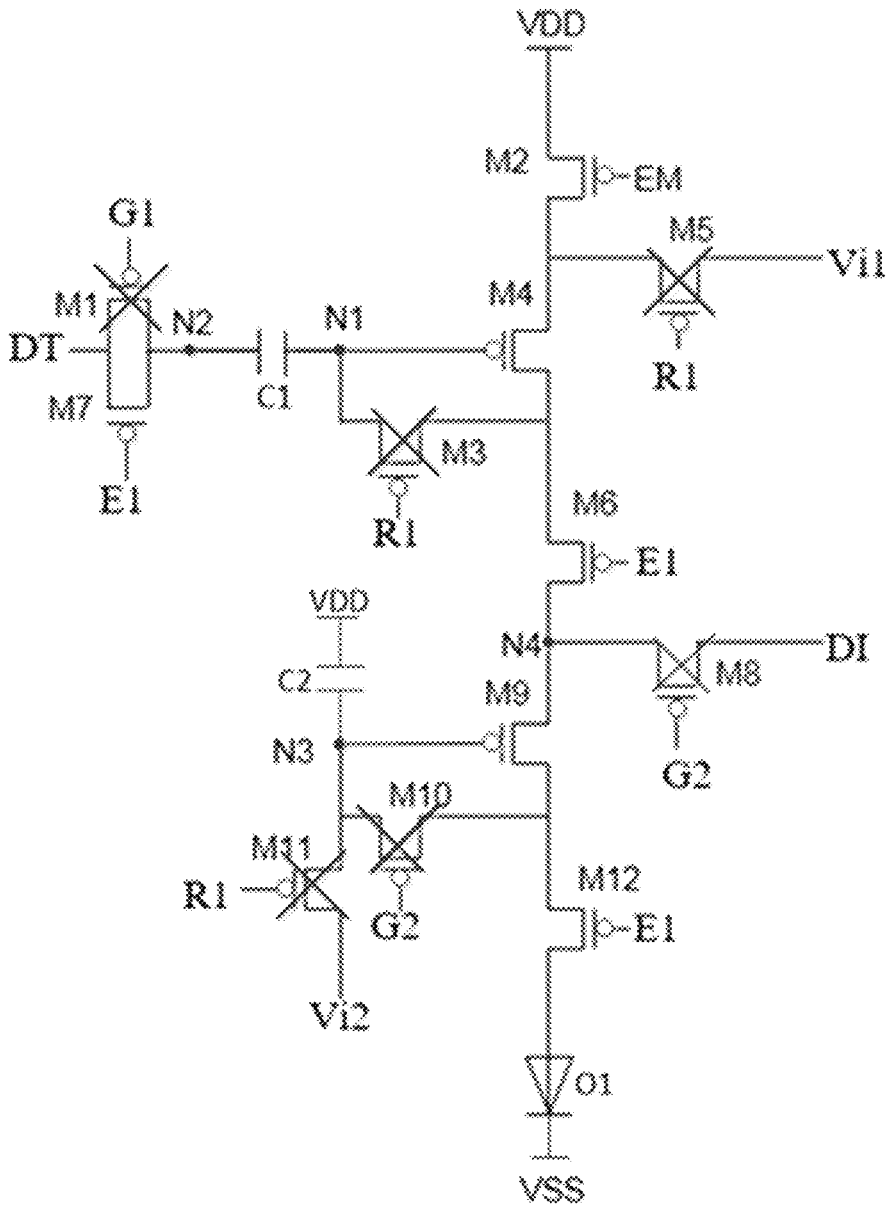
FIG. 12C is a schematic view showing an operating state of the pixel driving circuit in FIG. 10 within the light-emitting time period te according to one embodiment of the present disclosure.

At the light-emission stage, as shown in FIG. 12C, a high level may be applied to G1 and G2 to turn off M1, M8 and M10, a high level may be applied to R1 to maintain M3, M5 and M11 to be each in an off state, and a low level may be applied to E1 to turn on M2, M6, M7 and M12. At this time, FIG. 11 shows a waveform of the time control data voltage applied by DT. As shown in FIG. 11, the time control data voltage decreases at a constant slope from the voltage of 0V until the beginning of a next frame. A voltage value of the time control data voltage may be a predetermined voltage.

At the light-emission stage, when the time control data voltage decreases from 0V to VdT, based on the principle of charge conversation, a voltage of the gate electrode of M4 may jump to the threshold voltage Vth4 of M4, and a gate-to-source voltage Vgs4 of M4 may be equal to Vth4−VDD, where VDD is 0V or less, i.e., Vgs4=VdT−VDD>Vth4. When the time control data voltage jumps from 0V to VdT, M4 may be turned on. A turn-on time of M4 may depend on VdT, i.e., it may be independent of the threshold voltage of M4. M9 is a driving transistor for generating a current. According to a driving current calculation equation, $Id=K(Vgs9-Vth9)^2=K(VdI+Vth9-VDD-Vth9)^2=K(VdI-VDD)^2$, where Vgs9 represents a gate-to-source voltage of M9, K represents a current coefficient of M9, and Id is the driving current generated by M9. Based on the above equation, Id may be independent of Vth9.

At the light-emission stage, M9 may be at a saturation region.

During the operation of the pixel driving circuit in FIG. 10, M9 may generate the driving current, and M4 may control the light-emission time. Through different driving currents in combination with different light-emission times, it is able to provide more grayscale values. In addition, it is able to compensate for the threshold voltage drift, thereby to prevent a display effect from being adversely effected by the threshold voltage drift of M4 and the threshold voltage drift of M9 due to the low-temperature polycrystalline silicon technology.

In FIG. 11, Vn1 represents a voltage of N1, and Vn4 represents a voltage of N4. Theoretically, Vn4 may be equal to a difference between the potential at N3 and Vth4.

During the implementation, the pixel driving circuit is configured to drive the light-emitting element. The output end may be electrically connected to the first electrode of the light-emitting element, and the second electrode of the light-emitting element may be electrically connected to a third voltage end.

In some embodiments of the present disclosure, the third voltage end may be, but not limited to, a low voltage end.

Figure 13:
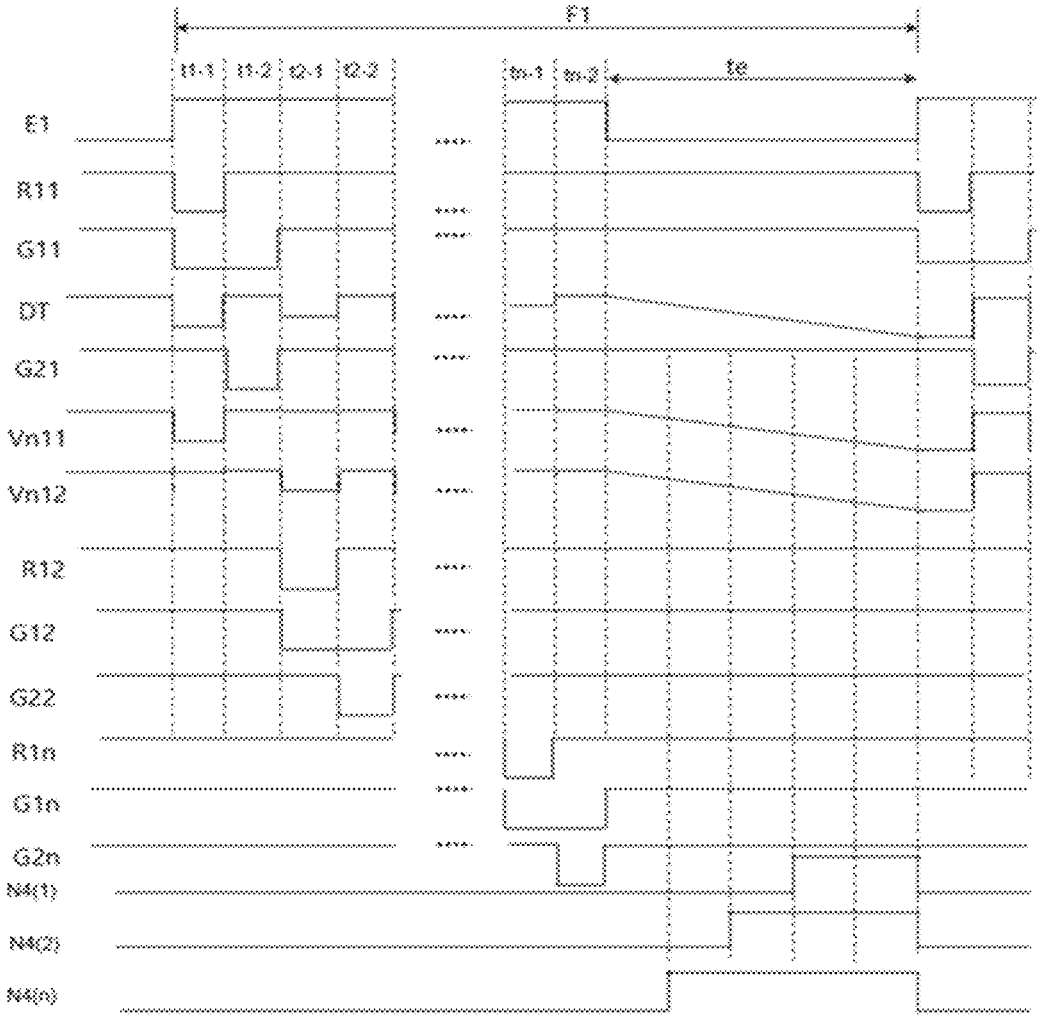
FIG. 13 is another sequence diagram of the pixel driving circuits in rows according to one embodiment of the present disclosure.

In some embodiments of the present disclosure, a display panel may include the pixel driving circuits arranged in rows and columns. As shown in FIG. 13, one frame may include a preparation stage and the light-emission stage to arranged one after another. The preparation stage may include a plurality of preparation time periods arranged one after another, and each preparation time period may include a resetting time period and a compensation time period arranged one after another.

In FIG. 13, F1 represents one frame, t1-1 represents a first resetting time period, t1-2 represents a first compensation time period, t2-1 represents a second resetting time period, t2-2 represents a second compensation time period, tn-1 represents an $n^{th}$ resetting time period, tn-2 represents an $n^{th}$ compensation time period, E1 represents the light-emission control line, DTm represents an $m^{th}$ time control data line, R11 represents a first resetting control line, G11 represents a first gate line in a first row, R12 represents a second resetting control line, G12 represents a first gate line in a second row, Gln represents a first gate line in an $n^{th}$ row, G21 represents a second gate line in the first row, G22 represents a second gate line in the second row, G2*n* represents a second gate line in the $n^{th}$ row, R1*n* represents an $n^{th}$ resetting control line, N4(1) represents a voltage of a fourth node in a pixel driving circuit in a first row and an $m^{th}$ column, N4(2) represents a voltage of a fourth node in a pixel driving circuit in the a second row and the $m^{th}$ column, N4(*n*) represents a voltage of a fourth node in a pixel driving circuit in an $n^{th}$ row and the $m^{th}$ column, where n is an integer greater than 2.

In FIG. 13, Vn11 represents a potential at a first node N1 in a pixel driving circuit in the first row and the $m^{th}$ column, and Vn12 represents a potential at a first node N1 in a pixel driving circuit in the second row and the $m^{th}$ column.

As shown in FIG. 13, within t1-1, a first time control data voltage VdT1 may be written into DTm; within t1-2, a voltage of 0V may be written into DTm; within t2-1, a second time control data voltage VdT2 may be written into DTm; within t2-2, a voltage of 0V may be written into DTm; within tn−1, an $n^{th}$ time control data voltage VdTn may be written into DTm; and within tn-2, a voltage of 0V may be written into DTm. At te, the data voltage on DTm may decrease at a constant slope from 0V, so as to control the light-emission time of micro LED in each row.

A method of driving the above-mentioned pixel driving circuit is further provided in some embodiments of the present disclosure, which includes: applying an ON signal to the resetting control line and the first gate line, so as to write a first initial voltage Vi1 into the first end of the light-emission time control sub-circuitry, enable the control end of the light-emission time control sub-circuitry to be electrically connected to the second end of the light-emission time control sub-circuitry, write a predetermined time control data voltage VdT from the time control data line into the second end of the first energy storage sub-circuitry, and enable the first end of the light-emission time control sub-circuitry to be electrically connected to the second end of the light-emission time control sub-circuitry, thereby to change a voltage applied to the first end of the first energy storage sub-circuitry until the light-emission time control sub-circuitry has been turned off; applying an ON signal to the first gate line, so as to write a predetermined voltage V0 from the time control data line into the second end of the first energy storage sub-circuitry, thereby to change the voltage applied to the first end of the first energy storage sub-circuitry; and applying an ON signal to the light-emission control line, so as to enable the first end of the light-emission time control sub-circuitry to be electrically connected to the first voltage end, and enable the time control data line to be electrically connected to the second end of the first energy storage sub-circuitry, thereby to change the voltage applied to the first end of the first energy storage sub-circuitry and enable the first end of the light-emission time control sub-circuitry to be electrically connected to, or electrically disconnected from, the second end of the light-emission time control sub-circuitry.

According to the method in the embodiments of the present disclosure, a luminous brightness value may be determined through controlling a light-emission time of the light-emitting element, so it is able to prevent the occurrence of chromaticity coordinate offset at different currents and unstable brightness at a low current density for the light-emitting element, adjust the luminous brightness value through adjusting the light-emission time of the light-emitting element at a fixed large current density, and compensate for the luminous brightness value when a threshold voltage drift occurs for a transistor due to a low-temperature polycrystalline silicon technology.

In some embodiments of the present disclosure, the ON signal may be a signal capable of controlling a corresponding sub-circuitry to be in an on state. For example, when the transistor in the sub-circuitry is an n-type transistor, the ON signal may be a high voltage signal, and when the transistor in the sub-circuitry is a p-type transistor, the ON signal may be a low voltage signal. However, the present disclosure shall not be limited thereto.

In a possible embodiment of the present disclosure, when applying the ON signal to the light-emission control line, the data voltage applied by the time control data line may be equal to V0-Kt, where t represents a duration of the light-emission stage. When the light-emission time control transistor of the light-emission time control sub-circuitry is a p-type transistor, K may be a positive number, and when the light-emission time control transistor of the light-emission time control sub-circuitry is an n-type transistor, K may be a negative number.

In a possible embodiment of the present disclosure, the pixel driving circuit may further include a current driving sub-circuitry. The method may further include, when applying the ON signal to the light-emission control line, generating, by the current driving sub-circuitry, a driving current to be outputted to the output end in accordance with a current control data voltage from the current control data line.

According to the method in the embodiments of the present disclosure, the current driving sub-circuitry may control a size of the driving current for driving the light-emitting element to emit light, and the other sub-circuitries of the pixel driving circuit may control the light-emission time of the light-emitting element. The luminous brightness may be adjusted through adjusting the driving current and the light-emission time simultaneously.

When the method in the embodiments of the present disclosure is used to drive a micro LED, based on such characteristics of the micro LED as low efficiency and main peak offset at a low current density as well as high efficiency at a high current density, various grayscale values may be provided through driving the micro LED by a current at the high current density and driving the micro LED by a large current at a low current density, in combination with the adjustment of the light-emission time.

In a possible embodiment of the present disclosure, the current driving sub-circuitry may include a driving sub-circuitry, a current control data write-in sub-circuitry, a second resetting sub-circuitry, a compensation sub-circuitry and a second energy storage sub-circuitry, and the output end is electrically connected to a light-emitting element. The method may further include: when applying the ON signal to the resetting control line and the first gate line, writing a second initial voltage into a control end of the driving sub-circuitry, so as to enable a first end of the driving sub-circuitry to be electrically disconnected from a second end of the driving sub-circuitry; when applying the ON signal to the first gate line, applying an ON signal to a second gate line, so as to write the predetermined current control data voltage VdT from the current control data line into the first end of the driving sub-circuitry, and enable the control end of the driving sub-circuitry to be electrically connected to the second end of the driving sub-circuitry, thereby to change a potential at the control end of the driving sub-circuitry until the driving sub-circuitry has been turned off; and when applying the ON signal to the light-emission control line, generating, by the driving sub-circuitry, a driving current for driving the light-emitting element to emit light.

A display device including the above-mentioned pixel driving circuit is further provided in some embodiments of the present disclosure.

The display device may be any product or member having a display function, e.g., a mobile phone, a flat-panel computer, a television, a display, a laptop computer, a digital photo frame or a navigator.

The above embodiments are for illustrative purposes only, but the present disclosure is not limited thereto. Obviously, a person skilled in the art may make further modifications and improvements without departing from the spirit of the present disclosure, and these modifications and improvements shall also fall within the scope of the present disclosure.

What is claimed is:

1. A pixel driving circuit, comprising a light-emission time control sub-circuitry, a first energy storage sub-circuitry, a first resetting sub-circuitry, a first light-emission control sub-circuitry, a time control data write-in sub-circuitry and a data control sub-circuitry, wherein the first resetting sub-circuitry is electrically connected to a resetting control line, a first initial voltage end, and a first end, a control end and a second end of the light-emission time control sub-circuitry, and configured to write a first initial voltage from the first initial voltage end into the first end of the light-emission time control sub-circuitry under the control of a resetting control signal from the resetting control line, and control the control end of the light-emission time control sub-circuitry to be electrically connected to the second end of the light-emission time control sub-circuitry under the control of the resetting control signal, wherein a first end of the first energy storage sub-circuitry is electrically connected to the control end of the light-emission time control sub-circuitry, and the first energy storage sub-circuitry is configured to store a voltage, wherein the time control data write-in sub-circuitry is electrically connected to a first gate line, a time control data line and a second end of the first energy storage sub-circuitry, and configured to control the time control data line to be electrically connected to the second end of the first energy storage sub-circuitry under the control of a first gate driving signal from the first gate line, wherein the data control sub-circuitry is electrically connected to a light-emission control line, the time control data line and the second end of the first energy storage sub-circuitry, and configured to control the time control data line to be electrically connected to the second end of the first energy storage sub-circuitry under the control of a light-emission control signal from the light-emission control line, wherein the first light-emission control sub-circuitry is electrically connected to the light-emission control line, the first end of the light-emission time control sub-circuitry and a first voltage end, and configured to control the first end of the light-emission time control sub-circuitry to be electrically connected to the first voltage end under the control of the light-emission control signal, wherein the second end of the light-emission time control sub-circuitry is electrically connected to an output end, and the light-emission time control sub-circuitry is configured to control the first end of the light-emission time control sub-circuitry to be electrically connected to the second end of the light-emission time control sub-circuitry under the control of a potential at the control end of the light-emission time control sub-circuitry, wherein the pixel driving circuit further comprises a current driving sub-circuitry connected between the second end of the light-emission time control sub-circuitry and the output end, electrically connected to a current control data line and the output end, and configured to generate a driving current to be outputted to the output end at a light-emission stage in accordance with a current control data voltage from the current control data line, wherein the current driving sub-circuitry comprises a driving sub-circuitry, a current control data write-in sub-circuitry, wherein a first end of the driving sub-circuitry is electrically connected to the second end of the light-emission time control sub-circuitry, a second end of the driving sub-circuitry is electrically connected to the output end, and the driving sub-circuitry is configured to control the first end of the driving sub-circuitry to be electrically connected to the second end of the driving sub-circuitry under the control of a potential at a control end of the driving sub-circuitry, wherein the current control data write-in sub-circuitry is electrically connected to a second gate line, the current control data line and the first end of the driving sub-circuitry, and configured to control the current control data line to be electrically connected to the first end of the driving sub-circuitry under the control of a second gate driving signal from the second gate line, and wherein the current driving sub-circuitry further comprises a second resetting sub-circuitry, a compensation sub-circuitry and a second energy storage sub-circuitry; a first end of the second energy storage sub-circuitry is electrically connected to the control end of the driving sub-circuitry, a second end of the second energy storage sub-circuitry is electrically connected to a second voltage end, and the second energy storage sub-circuitry is configured to store a voltage; the second resetting sub-circuitry is electrically connected to the resetting control line, a second initial voltage end and the control end of the driving sub-circuitry, and configured to apply a second initial voltage from the second initial voltage end to the control end of the driving sub-circuitry under the control of the resetting control signal from the resetting control line; and the compensation sub-circuitry is electrically connected to the second gate line, the control end of the driving sub-circuitry and the second end of the driving sub-circuitry, and configured to control the control end of the driving sub-circuitry to be electrically connected to the second end of the driving sub-circuitry under the control of the second gate driving signal.

2. The pixel driving circuit according to claim 1, further comprising a second light-emission control sub-circuitry electrically connected to the light-emission control line, the second end of the light-emission time control sub-circuitry and the output end, and configured to control the second end of the light-emission time control sub-circuitry to be electrically connected to the output end under the control of the light-emission control signal.

3. The pixel driving circuit according to claim 2, wherein the second light-emission control sub-circuitry comprises a second light-emission control transistor, a control electrode of which is electrically connected to the light-emission control line, a first electrode of which is electrically connected to the second end of the light-emission time control sub-circuitry, and a second electrode of which is electrically connected to the output end.

4. The pixel driving circuit according to claim 1, wherein the light-emission time control sub-circuitry comprises a light-emission time control transistor, a control electrode of which is the control end of the light-emission time control sub-circuitry, a first electrode of which is the first end of the light-emission time control sub-circuitry, and a second electrode of which is the second end of the light-emission time control sub-circuitry;

the first resetting sub-circuitry comprises a first resetting transistor and a second resetting transistor; a control electrode of the first resetting transistor is electrically connected to the resetting control line, a first electrode of the first resetting transistor is electrically connected to the control end of the light-emission time control sub-circuitry, and a second electrode of the first resetting transistor is electrically connected to the second end of the light-emission time control sub-circuitry; and a control electrode of the second resetting transistor is electrically connected to the resetting control line, a first electrode of the second resetting transistor is electrically connected to the first end of the light-emission time control sub-circuitry, and a second electrode of the second resetting transistor is electrically connected to the first initial voltage end for applying the first initial voltage.

5. The pixel driving circuit according to claim 1, wherein the time control data write-in sub-circuitry comprises a time control data write-in transistor, a control electrode of which is electrically connected to the first gate line, a first electrode of which is electrically connected to the time control data line, and a second electrode of which is electrically connected to the second end of the first energy storage sub-circuitry;

the data control sub-circuitry comprises a data control transistor, and the first energy storage sub-circuitry comprises a time control capacitor; a control electrode of the data control transistor is electrically connected to the light-emission control line, a first electrode of the data control transistor is electrically connected to the time control data line, and a second electrode of the data control transistor is electrically connected to the second end of the first energy storage sub-circuitry; and the first end of the first energy storage sub-circuitry is a first end of the time control capacitor, and the second end of the first energy storage sub-circuitry is a second end of the time control capacitor.

6. The pixel driving circuit according to claim 1, wherein the first light-emission control sub-circuitry comprises a first light-emission control transistor, a control electrode of which is electrically connected to the light-emission control line, a first electrode of which is electrically connected to the first voltage end, and a second electrode of which is electrically connected to the first end of the light-emission time control sub-circuitry.

7. The pixel driving circuit according to claim 1, wherein the light-emission time control sub-circuitry comprises a light-emission time control transistor, the first resetting sub-circuitry comprises a first resetting transistor and a second resetting transistor, the time control data write-in sub-circuitry comprises a time control data write-in transistor, the data control sub-circuitry comprises a data control transistor, the first light-emission control sub-circuitry comprises a first light-emission control transistor, and the first energy storage sub-circuitry comprises a time control capacitor; a control electrode of the light-emission time control transistor is the control end of the light-emission time control sub-circuitry, a first electrode of the light-emission time control transistor is the first end of the light-emission time control sub-circuitry, and a second electrode of the light-emission time control transistor is the second end of the light-emission time control sub-circuitry; a control electrode of the first resetting transistor is electrically connected to the resetting control line, a first electrode of the first resetting transistor is electrically connected to the control end of the light-emission time control sub-circuitry, and a second electrode of the first resetting transistor is electrically connected to the second end of the light-emission time control sub-circuitry; a control electrode of the second resetting transistor is electrically connected to the resetting control line, a first electrode of the second resetting transistor is electrically connected to the first end of the light-emission time control sub-circuitry, and a second electrode of the second resetting transistor is electrically connected to the first initial voltage end for applying the first initial voltage; a control electrode of the time control data write-in transistor is electrically connected to the first gate line, a first electrode of the time control data write-in transistor is electrically connected to the time control data line, and a second electrode of the time control data write-in transistor is electrically connected to the second end of the first energy storage sub-circuitry; a control electrode of the data control transistor is electrically connected to the light-emission control line, a first electrode of the data control transistor is electrically connected to the time control data line, and a second electrode of the data control transistor is electrically connected to the second end of the first energy storage sub-circuitry; a control electrode of the first light-emission control transistor is electrically connected to the light-emission control line, a first electrode of the first light-emission control transistor is electrically connected to the first voltage end, and a second electrode of the first light-emission control transistor is electrically connected to the first end of the light-emission time control sub-circuitry; and the first end of the first energy storage sub-circuitry is a first end of the time control capacitor, and the second end of the first energy storage sub-circuitry is a second end of the time control capacitor.

8. The pixel driving circuit according to claim 7, further comprising a second light-emission control sub-circuitry, wherein the second light-emission control sub-circuitry comprises a second light-emission control transistor, a control electrode of which is electrically connected to the light-emission control line, a first electrode of which is electrically connected to the second end of the light-emission control sub-circuitry, and a second electrode of which is electrically connected to the output end.

9. The pixel driving circuit according to claim 1, further comprising a second light-emission control sub-circuitry through which the first end of the driving sub-circuitry is electrically connected to the second end of the light-emission time control sub-circuitry, wherein a control end of the second light-emission control sub-circuitry is electrically connected to the light-emission control line, a first end of the second light-emission control sub-circuitry is electrically connected to the second end of the light-emission time control sub-circuitry, and a second end of the second light-emission control sub-circuitry is electrically connected to the driving sub-circuitry; and the second light-emission control sub-circuitry is configured to control the second end of the light-emission time control sub-circuitry to be electrically connected to the driving sub-circuitry under the control of the light-emission control signal from the light-emission control line.

10. The pixel driving circuit according to claim 1, further comprising a third light-emission control sub-circuitry through which the second end of the driving sub-circuitry is electrically connected to the output end, wherein a control end of the third light-emission control sub-circuitry is electrically connected to the light-emission control line, and the third light-emission control sub-circuitry is configured to control the second end of the driving sub-circuitry to be electrically connected to the output end under the control of the light-emission control signal from the light-emission control line.

11. The pixel driving circuit according to claim 10, wherein the third light-emission control sub-circuitry comprises a third light-emission control transistor, a control electrode of which is electrically connected to the light-emission control line, a first electrode of which is electrically connected to the second end of the driving sub-circuitry, and a second electrode of which is electrically connected to the output end.

12. The pixel driving circuit according to claim 1, wherein the driving sub-circuitry comprises a driving transistor, the second energy storage sub-circuitry comprises a current control capacitor, the current control data write-in sub-circuitry comprises a current control data write-in transistor, the second resetting sub-circuitry comprises a third resetting transistor, and the compensation sub-circuitry comprises a compensation transistor; a control electrode of the driving transistor is electrically connected to a first end of the current control capacitor, a first electrode of the driving transistor is electrically connected to the second end of the light-emission time control sub-circuitry, and a second electrode of the driving transistor is electrically connected to the output end; a control electrode of the current control data write-in transistor is electrically connected to the second gate line, a first electrode of the current control data write-in transistor is electrically connected to the current control data line, and a second electrode of the current control data write-in transistor is electrically connected to the first end of the driving sub-circuitry; a control electrode of the third resetting transistor is electrically connected to the resetting control line, a first electrode of the third resetting transistor is electrically connected to the second initial voltage end, and a second electrode of the third resetting transistor is electrically connected to the control end of the driving sub-circuitry; and a control electrode of the compensation transistor is electrically connected to the second gate line, a first electrode of the compensation transistor is electrically connected to the control end of the driving sub-circuitry, and a second electrode of the compensation transistor is electrically connected to the second end of the driving sub-circuitry.

13. The pixel driving circuit according to claim 1, wherein the pixel driving circuit is configured to drive a light-emitting element, the output end is electrically connected to a first electrode of the light-emitting element, and a second electrode of the light-emitting element is electrically connected to a third voltage end.

14. The pixel driving circuit according to claim 13, wherein the light-emitting element is a micro Light-Emitting Diode (LED).

15. A method of driving the pixel driving circuit according to claim 1, comprising:

applying an ON signal to the resetting control line and the first gate line to write the first initial voltage into the first end of the light-emission time control sub-circuitry, enable the control end of the light-emission time control sub-circuitry to be electrically connected to the second end of the light-emission time control sub-circuitry, write a predetermined time control data voltage from the time control data line into the second end of the first energy storage sub-circuitry, enable the first end of the light-emission time control sub-circuitry to be electrically connected to the second end of the light-emission time control sub-circuitry, and change a voltage applied to the first end of the first energy storage sub-circuitry until the light-emission time control sub-circuitry has been turned off;

applying an ON signal to the first gate line to write a predetermined voltage from the time control data line into the second end of the first energy storage sub-circuitry, and to change the voltage applied to the first end of the first energy storage sub-circuitry; and applying an ON signal to the light-emission control line to enable the first end of the light-emission time control sub-circuitry to be electrically connected to the first voltage end, enable the time control data line to be electrically connected to the second end of the first energy storage sub-circuitry, change the voltage applied to the first end of the first energy storage sub-circuitry and enable the first end of the light-emission time control sub-circuitry to be electrically connected to, or electrically disconnected from, the second end of the light-emission time control sub-circuitry.

16. The method according to claim 15, wherein the pixel driving circuit further comprises a current driving sub-circuitry, wherein the method further comprises, when applying the ON signal to the light-emission control line, generating, by the current driving sub-circuitry, a driving current to be outputted to the output end in accordance with a current control data voltage from the current control data line.

17. The method according to claim 16, wherein the current driving sub-circuitry comprises a driving sub-circuitry, a current control data write-in sub-circuitry, a second resetting sub-circuitry, a compensation sub-circuitry and a second energy storage sub-circuitry, and the output end is electrically connected to a light-emitting element, wherein the method further comprises: when applying the ON signal to the resetting control line and the first gate line, writing a second initial voltage into a control end of the driving sub-circuitry to enable a first end of the driving sub-circuitry to be electrically disconnected from a second end of the driving sub-circuitry; when applying the ON signal to the first gate line, applying an ON signal to a second gate line to write the predetermined current control data voltage from the current control data line into the first end of the driving sub-circuitry, enable the control end of the driving sub-circuitry to be electrically connected to the second end of the driving sub-circuitry, and change a potential at the control end of the driving sub-circuitry until the driving sub-circuitry has been turned off; and when applying the ON signal to the light-emission control line, generating, by the driving sub-circuitry, a driving current for driving the light-emitting element to emit light.

18. A display device, comprising the pixel driving circuit according to claim 1.

* * * * *